US009478379B2

(12) United States Patent
Li et al.

(10) Patent No.: US 9,478,379 B2
(45) Date of Patent: Oct. 25, 2016

(54) POLARIZED ELECTROMAGNETIC RELAY

(71) Applicant: FUJITSU COMPONENT LIMITED, Tokyo (JP)

(72) Inventors: Ying Li, Tokyo (JP); Yoshinori Kurata, Tokyo (JP); Satoshi Takano, Tokyo (JP); Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 143 days.

(21) Appl. No.: 13/851,270

(22) Filed: Mar. 27, 2013

(65) Prior Publication Data

US 2013/0257566 A1 Oct. 3, 2013

(30) Foreign Application Priority Data

Mar. 30, 2012 (JP) ..... 2012-082359
Feb. 8, 2013 (JP) ..... 2013-023449

(51) Int. Cl.
*H01H 51/22* (2006.01)
*H01H 50/56* (2006.01)

(52) U.S. Cl.
CPC ..... *H01H 51/22* (2013.01); *H01H 51/2209* (2013.01); *H01H 50/56* (2013.01)

(58) Field of Classification Search
CPC ..... H01H 50/043; H01H 50/443; H01H 50/642; H01H 51/2227; H01H 51/2209; H01H 2051/2218; H01H 2050/446; H01H 51/22; H01H 50/56
USPC ..... 335/85
See application file for complete search history.

(56) References Cited

U.S. PATENT DOCUMENTS

| | | | | |
|---|---|---|---|---|
| 4,122,420 | A * | 10/1978 | Brown | 335/80 |
| 4,206,431 | A * | 6/1980 | Kimpel | 335/80 |
| 4,560,966 | A * | 12/1985 | Nagamoto et al. | 335/80 |
| 4,730,176 | A * | 3/1988 | Matsuo et al. | 335/230 |
| 7,679,476 | B2 | 3/2010 | Kubono et al. | |
| 2006/0279384 | A1 * | 12/2006 | Takayama et al. | 335/78 |
| 2008/0180197 | A1 * | 7/2008 | Kubono et al. | 335/78 |
| 2008/0231397 | A1 * | 9/2008 | Katou | 335/192 |

FOREIGN PATENT DOCUMENTS

| | | | |
|---|---|---|---|
| CN | 2508384 | | 8/2002 |
| CN | 101236863 | | 8/2008 |
| CN | 201527936 | | 7/2010 |
| DE | 2816555 | A1 * | 10/1978 |
| DE | 3837666 | A1 * | 5/1990 |
| JP | 6-176676 | | 6/1994 |
| JP | 2008-210776 | | 9/2008 |

* cited by examiner

*Primary Examiner* — Mohamad Musleh
(74) *Attorney, Agent, or Firm* — Staas & Halsey LLP

(57) ABSTRACT

A polarized electromagnetic relay including an electromagnet; a pair of magnetic pole pieces driven by the electromagnet; a permanent magnet attached to the magnetic pole pieces; a contact section including a first fixed contact member with a normally open fixed contact, a first movable contact member with a normally open movable contact, a second fixed contact member with a normally closed fixed contact, and a second movable contact member with a normally closed movable contact; and a transmission member to which the magnetic pole pieces is attached. In accordance with a rectilinear movement of the magnetic pole pieces in parallel to a coil center axis, the transmission member rectilinearly moves in parallel to the center axis and thereby causes the normally open and closed movable contacts to perform an opening or closing operation in a mutually interlocked manner.

8 Claims, 15 Drawing Sheets

POLARIZED ELECTROMAGNETIC RELAY

CROSS-REFERENCE TO RELATED APPLICATIONS

This application is based upon and claims the benefit of priority of the prior Japanese Application No. 2012-082359, filed Mar. 30, 2012, and No. 2013-023449, filed Feb. 8, 2013, the entire contents of which are incorporated herein by reference.

BACKGROUND OF THE INVENTION

1. Field of the Invention

The present invention relates to a polarized electromagnetic relay.

2. Description of the Related Art

An electromagnetic relay including at least one pair of normally open contacts and at least one pair of normally closed contacts, in which the pair of normally open contacts and the pair of normally closed contacts perform an opening or closing operation in a manner mechanically interlocked with each other in accordance with the movement of an armature, and the individual pair of contacts are arranged insulated from one another, has been known. This type of electromagnetic relay can be used as, e.g., a relay with forcibly guided contacts (also referred to as a safety relay) in which, the failure of any normally open contact to open (e.g., due to welding) has the effect that none of the normally closed contacts close even when the relay is not energized. A circuit incorporating such a safety relay can detect the welding of the pair of normally open contacts and can maintain a power shutoff condition.

An electromagnetic relay having a forcibly guided contact configuration is described in, e.g., Japanese Unexamined Patent Publication (Kokai) No. 6-176676 (JP6-176676A). The electromagnetic relay described in JP6-176676A includes an actuating member operating against the biasing force of a return spring in accordance with the swinging motion of an armature moving like a hinge, and is constructed so that a pair of normally open contacts and a pair of normally closed contacts perform an opening or closing operation in a manner mechanically interlocked with each other in accordance with the movement of the actuating member and the pair of normally open contacts and the pair of normally closed contacts can never be simultaneously in closed position. The actuating member moves in a direction perpendicular to the center axis of a coil of an electromagnet used to operate the armature. The electromagnet is placed so that the center axis of the coil is oriented perpendicularly to the bottom face of the relay.

On the other hand, in a polarized electromagnetic relay including the combination of an electromagnet and a permanent magnet, it is known to provide a low-profile configuration in which the electromagnet is placed so that the center axis of a coil is oriented in parallel to the bottom face of the relay, and in which an armature with the permanent magnet attached thereto is reciprocated in a direction parallel to the center axis of the coil (refer to, e.g., Japanese Unexamined Patent Publication (Kokai) No. 2008-210776 (JP2008-210776A)). The polarized electromagnetic relay described in JP2008-210776A has a so-called transfer-type contact configuration, comprising a single movable contact spring member that supports a movable make (or normally open) contact and a movable break (or normally closed) contact in a back-to-back configuration, a first fixed contact terminal member that supports a fixed make (or normally open) contact capable of contacting and separating from the movable make contact, and a second fixed contact terminal member that supports a fixed break (or normally closed) contact capable of contacting and separating from the movable break contact.

SUMMARY OF THE INVENTION

One aspect of the present invention provides a polarized electromagnetic relay comprising an electromagnet including a coil; a pair of magnetic pole pieces driven by the electromagnet; a permanent magnet attached to the pair of magnetic pole pieces; a contact section including a first fixed contact member provided with a normally open fixed contact, a first movable contact member provided with a normally open movable contact capable of contacting and separating from the normally open fixed contact, a second fixed contact member provided with a normally closed fixed contact, and a second movable contact member proved with a normally closed movable contact capable of contacting and separating from the normally closed fixed contact; and a transmission member to which the pair of magnetic pole pieces is attached, the transmission member capable of transmitting a movement of the pair of magnetic pole pieces to the first movable contact member and the second movable contact member so as to cause the normally open movable contact and the normally closed movable contact to perform an opening or closing operation; wherein the pair of magnetic pole pieces holds therebetween the permanent magnet in a magnetization direction of the permanent magnet and is disposed to orient the magnetization direction in parallel with a center axis of the coil, the pair of magnetic pole pieces being rectilinearly movable together with the permanent magnet in an integrated manner in a direction parallel to the center axis; and wherein, in accordance with a rectilinear movement of the pair of magnetic pole pieces in the direction parallel to the center axis, the transmission member rectilinearly moves in the direction parallel to the center axis and thereby causes the normally open movable contact and the normally closed movable contact to perform the opening or closing operation in a mutually interlocked manner.

DESCRIPTION OF THE EMBODIMENT

Figure 1:
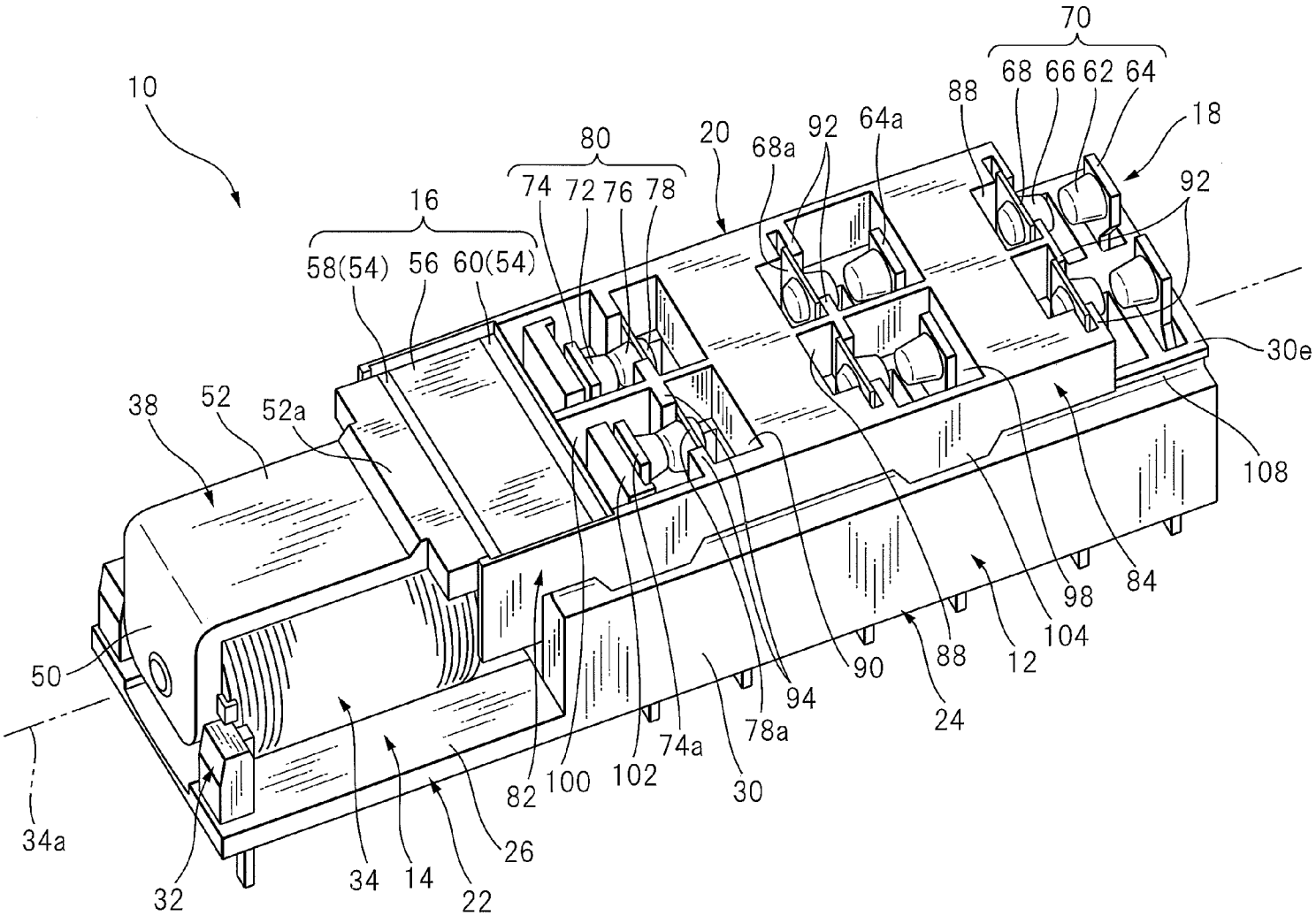
FIG. 1 is a perspective view depicting a polarized electromagnetic relay according to one embodiment.

The embodiments of the present invention are described below, in detail, with reference to the accompanying drawings. In the drawings, the same or similar components are denoted by common reference numerals.

FIGS. 1 to 5 depict the configuration of a polarized electromagnetic relay 10 according to one embodiment. FIGS. 6 to 13 depict components of the polarized electromagnetic relay 10.

The polarized electromagnetic relay 10 includes a base section 12, an electromagnet 14 supported on the base section 12, a movable magnetic member 16 moving in accordance with the operation of the electromagnet 14, a contact section 18 insulated from the electromagnet 14 and supported on the base section 12, and a transmission member 20 disposed between the electromagnet 14 and the contact section 18 and moving together with the movable magnetic member 16 in accordance with the operation of the electromagnet 14 so as to open and close the contact section 18 (FIGS. 1 to 4).

The base section 12 includes a first portion 22 supporting the electromagnet 14 and a second portion 24 supporting the contact section 18. In the plan view of FIG. 3, the base section 12 has a substantially rectangular profile. The first portion 22 and second portion 24, each having a substantially rectangular profile, are disposed adjacent each other along the longitudinal direction of the base section 12. The base section 12 can be integrally formed by, e.g., injection molding from an electrically insulating resin material.

The first portion 22 is provided with a bottom plate 26 on which the electromagnet 14 is mounted. The second portion 24 is provided with an enclosing wall 30 protruding upward relative to the bottom plate 26 of the first portion 22, and the enclosing wall 30 defines a plurality of accommodation holes 28 respectively accommodating one of a plurality of contact members of the contact section 18. The enclosing wall 30 provides electrical insulation between the electromagnet 14 and the contact members of the contact section 18. A bottom face 26*a* of the bottom plate 26 and a bottom face 30*a* of the enclosing wall 30 lie in substantially the same plane, and constitute the entire bottom face of the polarized electromagnetic relay 10 (FIG. 5).

Figure 11A:
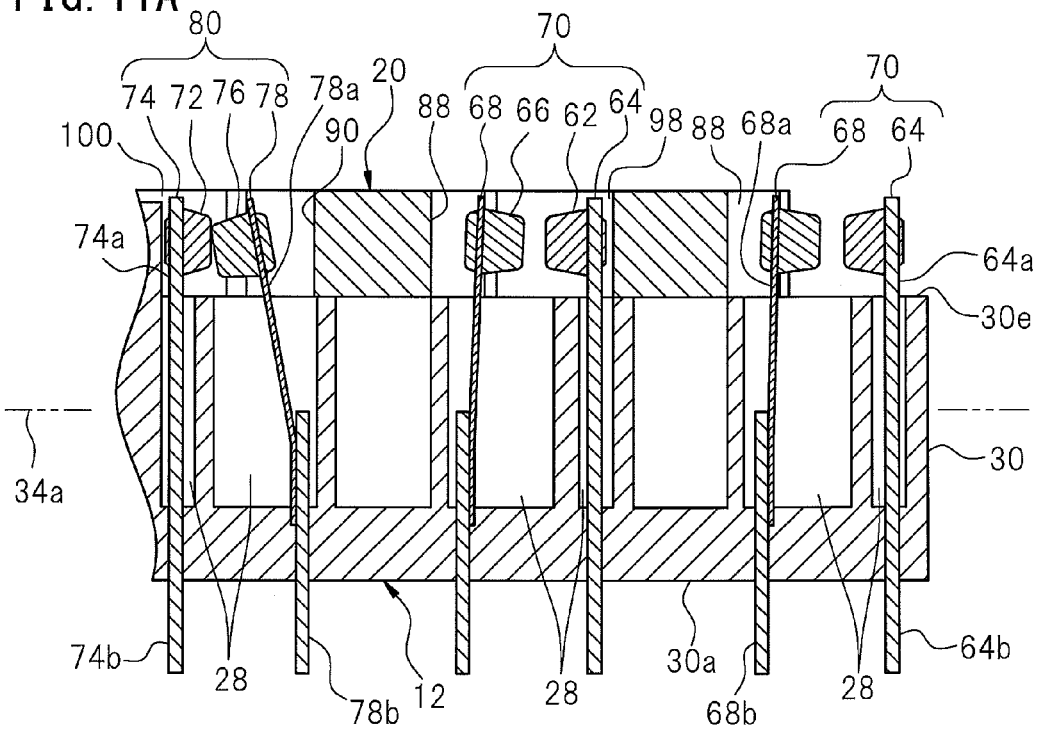
FIG. 11A is a diagram for explaining the operation of the contact section and the reciprocating movement of the transmission member in a returned state.
Figure 11B:
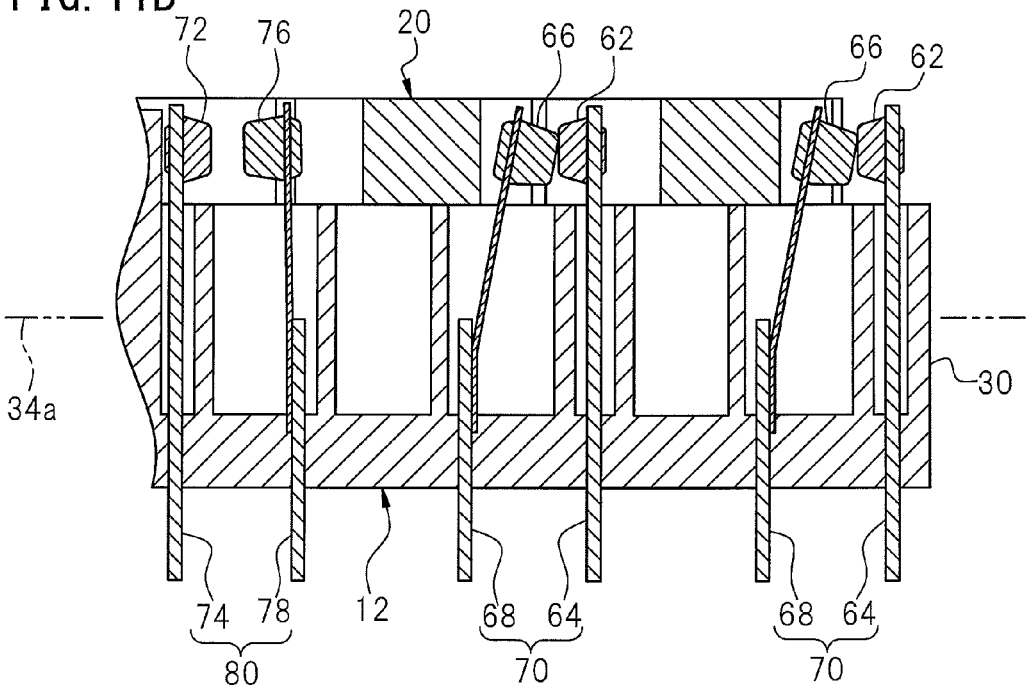
FIG. 11B is a diagram for explaining the operation of the contact section and the reciprocating movement of the transmission member in an operating state.

The enclosing wall 30 includes a peripheral wall portion 30*b* arranged along the profile of the second portion 24, a center wall portion 30*c* extending in the longitudinal direction of the base section 12, and a plurality of transverse wall portions 30*d* extending substantially perpendicular to the center wall portion 30*c*. The plurality of accommodation holes 28 are arranged longitudinally in two rows, one on each side of the center wall portion 30*c* and each row having an equal number of accommodation holes, in such a manner as to be symmetrical about the center wall portion 30*c*. In the illustrated example, variously-sized eight recesses extending in a direction substantially perpendicular to the bottom face 30*a* are formed on each side of the center wall portion 30*c* (a total of sixteen recesses on both sides), and six of these recesses (twelve recesses on both sides) serve as the accommodation holes 28 (FIGS. 11A and 11B).

Figure 4:
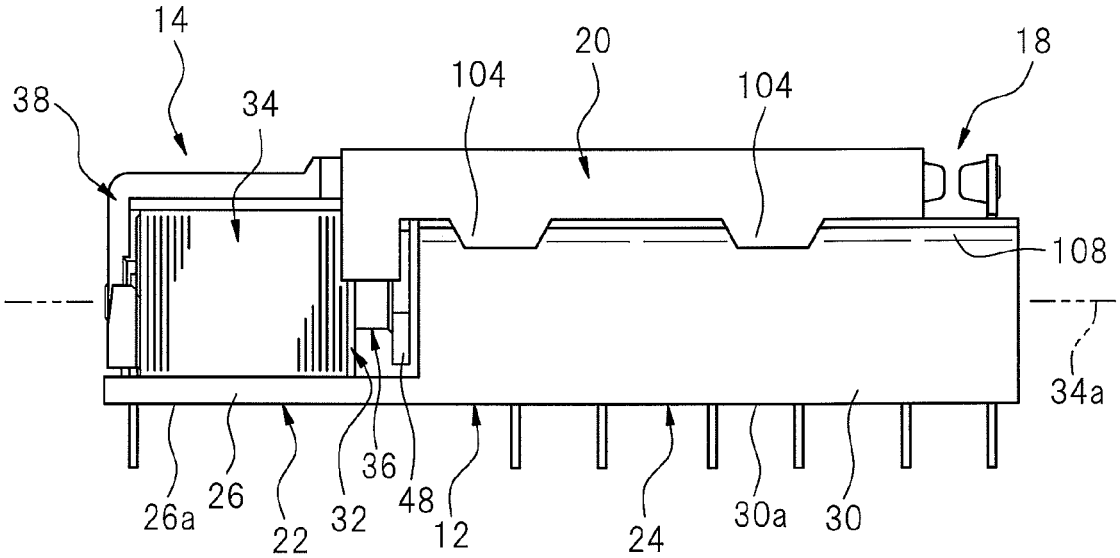
FIG. 4 is a front view depicting the polarized electromagnetic relay.

The electromagnet 14 includes a bobbin 32, a coil 34 wound around the bobbin 32, an iron core 36 received in the bobbin 32, and a yoke 38 connected to the core 36 and extending outside the coil 34. The electromagnet 14 is mounted on the bottom plate 26 of the first portion 22 in such a manner that the center axis 34*a* of the coil 34 is oriented along the longitudinal direction of the base section 12 and substantially in parallel to the bottom faces 26*a* and 30*a* of the base section 12 (FIG. 4).

Figure 5:
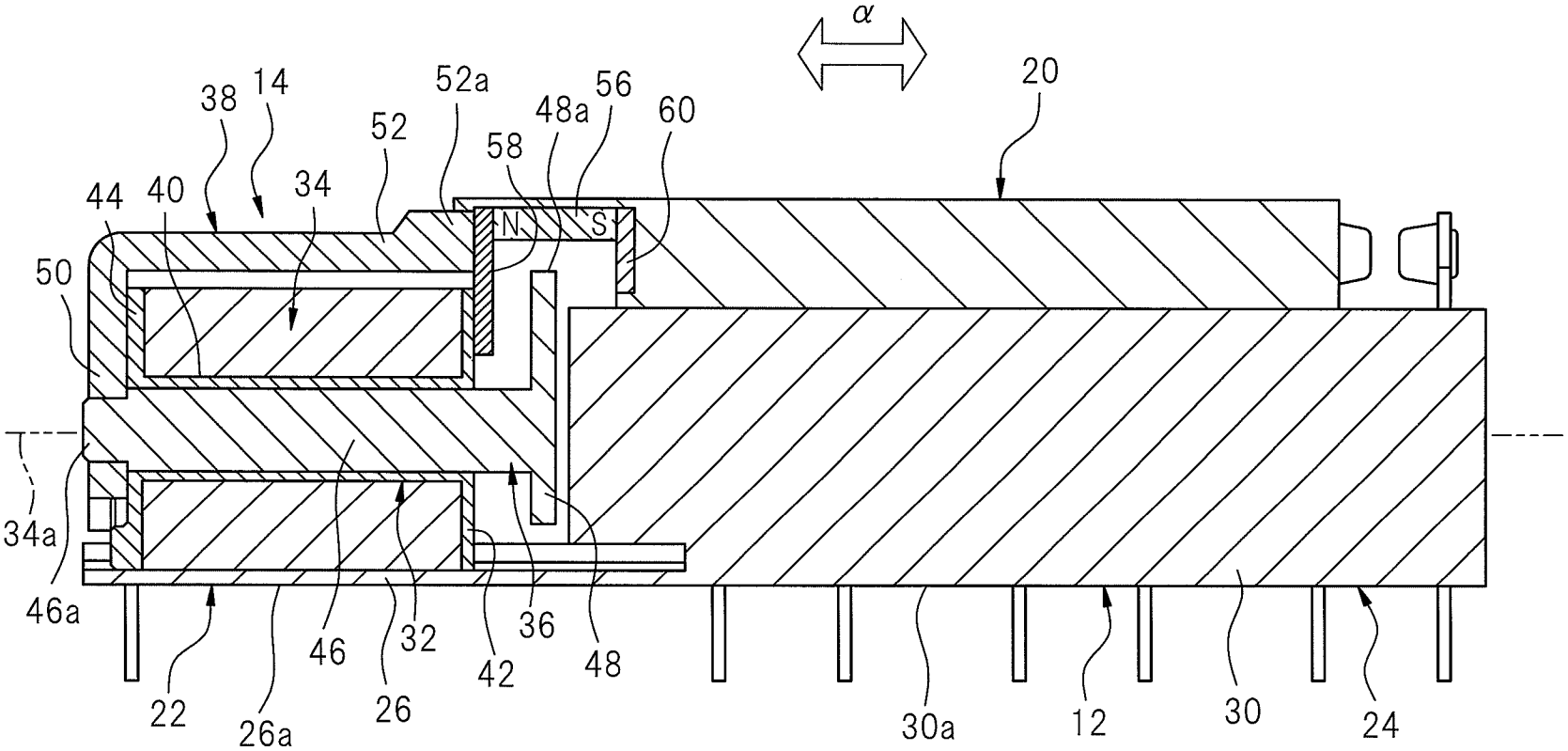
FIG. 5 is a sectional view of the polarized electromagnetic relay.

The bobbin 32 includes a hollow cylindrical body 40 and annular flat plate-like first flange 42 and second flange 44 provided at longitudinally opposite ends of the body 40 (FIG. 5). The coil 34 is formed by winding a conducting wire around the body 40 of the bobbin 32, and is held fixedly between the first flange 42 and the second flange 44. The bobbin 32 can be integrally formed by, e.g., injection molding from an electrically insulating resin material. The bobbin 32 is provided, at the side of the second flange 44, with two coil terminals 45 respectively connected to the distal ends of the conducting wire forming the coil 34.

The iron core 36 includes a cylindrical shaft 46 disposed inside the coil 34 along the center axis 34*a* thereof, and a flat plate-like head portion 48 disposed outside the coil 34 and extending radially outward from one axial end of the shaft 46. The shaft 46 is housed inside the body 40, and has a length so that the opposite ends of the shaft respectively protrude from the first and second flanges 42 and 44 (FIG. 5). The head portion 48 is disposed so as to face the first flange 42 with a prescribed gap defined therebetween, and is shaped and dimensioned so that a region 48*a* along the outer periphery of the head portion (hereinafter referred to as a peripheral region 48*a*) slightly protrudes outward from the first flange 42 in the radial direction of the coil. The core 36 can be integrally formed from, e.g., magnetic steel.

The yoke 38 is connected to the axial end 46*a* of the shaft 46 opposite to the head portion 48, and disposed outside the coil 34 to extend toward the head portion 48 (FIG. 5). The yoke 38 includes a short and flat plate-like connecting portion 50 connected to the shaft 46 and disposed along the second flange 44, and a long and flat plate-like major portion 52 disposed substantially orthogonally to the connecting portion 50 at one lateral side of the coil 34 and extending in a direction substantially parallel to the coil center axis 34*a*. The major portion 52 of the yoke 38 is provided with a distal end region 52*a* located at a lateral side of the first flange 42 of the bobbin 32 and spaced apart from the peripheral region 48*a* of the head portion 48 (FIG. 5). The yoke 38 can be integrally formed as an L-shaped plate from, e.g., magnetic steel. The shaft 46 is fixedly connected to the connecting portion 50 of the yoke 38 by, e.g., crimping. The core 36 cooperates with the yoke 38 to form a magnetic path around the coil 34.

The electromagnet 14 is supported on the base section 12 while being oriented so that the head portion 48 is located between the coil 34 and the contact section 18. In other words, as viewed from a side adjacent to the coil terminals 45, the connecting portion 50 of the yoke 38, the coil 34, the head portion 48 of the core 36, and the contact section 18 are arranged substantially in this order. When the electromagnet 14 is oriented in this manner, it becomes possible to change a relationship between a travel or moving distance of an armature 54 and a magnetic attractive force, compared with a reverse configuration in which the head portion 48 of the core 36 is positioned at a side spaced away from the contact section 18.

Figure 2:
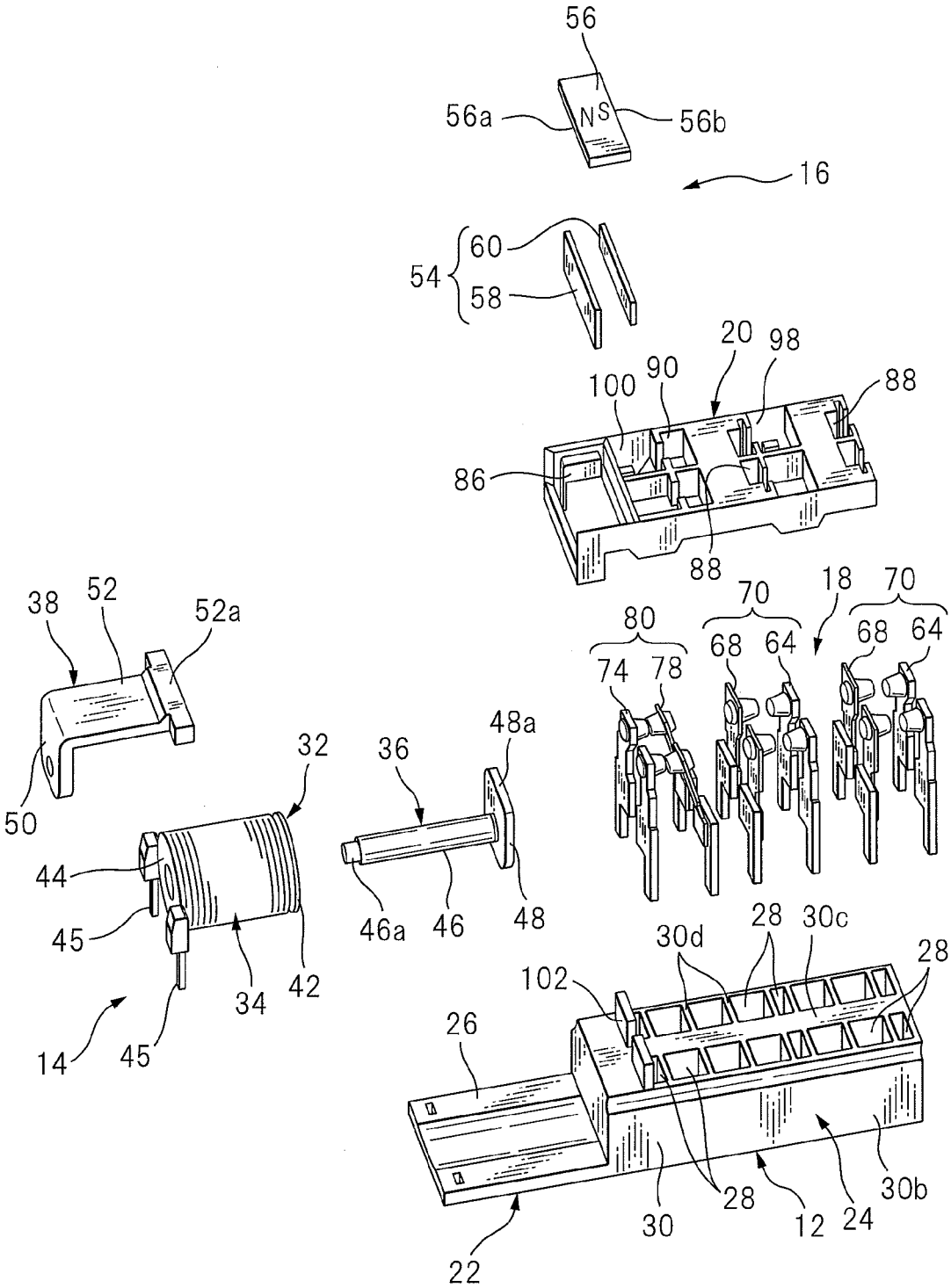
FIG. 2 is an exploded perspective view depicting the polarized electromagnetic relay.

The movable magnetic member 16 includes the armature 54 disposed in the magnetic path of the electromagnet 14 and driven by the electromagnet 14, and a single permanent magnet 56 attached to the armature 54. The armature 54 includes a first magnetic pole piece 58 and a second magnetic pole piece 60, each having a rectangular and flat plate-like shape and formed from a magnetic material such as magnetic steel. The permanent magnet 56 has a rectangular parallelepiped shape, and an N pole and an S pole are formed respectively on the lateral faces 56*a* and 56*b* thereof (FIG. 2). The first magnetic pole piece 58 and the second magnetic pole piece 60 hold therebetween the permanent magnet 56 in a magnetization direction of the permanent magnet, and are disposed so as to orient the magnetization direction in parallel with the center axis 34*a* of the coil 34 and to face the peripheral region 48*a* (FIG. 5).

The movable magnetic member 16 including the armature 54 and the permanent magnet 56 is arranged so as to be rectilinearly movable in a reciprocating manner in a direction parallel to the coil center axis 34*a* (a direction indicated by an arrow $\alpha$ in FIG. 5) in a condition where a part of the first magnetic pole piece 58 is positioned between the peripheral region 48*a* of the head portion 48 and the end region 52*a* of the major portion 52 of the yoke 38. In other words, the first and second magnetic pole pieces 58 and 60 are rectilinearly movable together with the permanent magnet 56 in an integrated manner in a direction parallel to the coil center axis 34*a*. The reciprocating range or maximum travel of the movable magnetic member 16 is defined by limit positions of movement where the first magnetic pole piece 58 comes into contact respectively with the peripheral region 48*a* of the head portion 48 of the core 36 and the end region 52*a* of the major portion 52 of the yoke 38.

Figure 7:
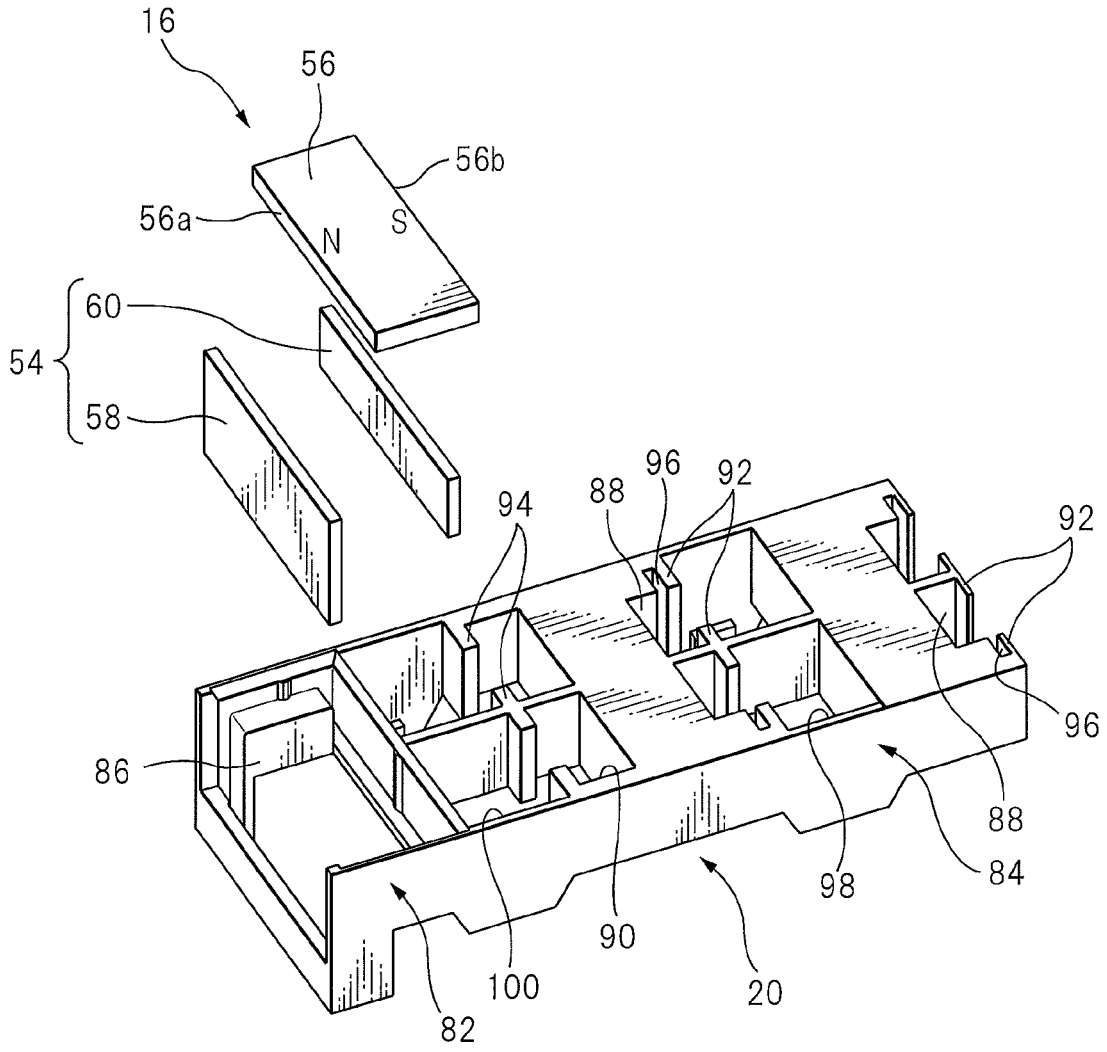
FIG. 7 is an exploded perspective view depicting a movable magnetic member and a transmission member.

The first and second magnetic pole pieces 58 and 60 in the present embodiment have respective sizes or dimensions different from each other in a direction perpendicular to the coil center axis 34*a*. In the illustrated configuration, when viewed in a direction perpendicular to the coil center axis 34*a* and the bottom faces 26*a* and 30*a* of the base section 12, the first magnetic pole piece 58 has a greater dimension than the second magnetic pole piece 60 (FIGS. 2, 5 and 7). The other dimensions of the first magnetic pole piece 58 are substantially identical to those of the second magnetic pole piece 60.

Figure 6:
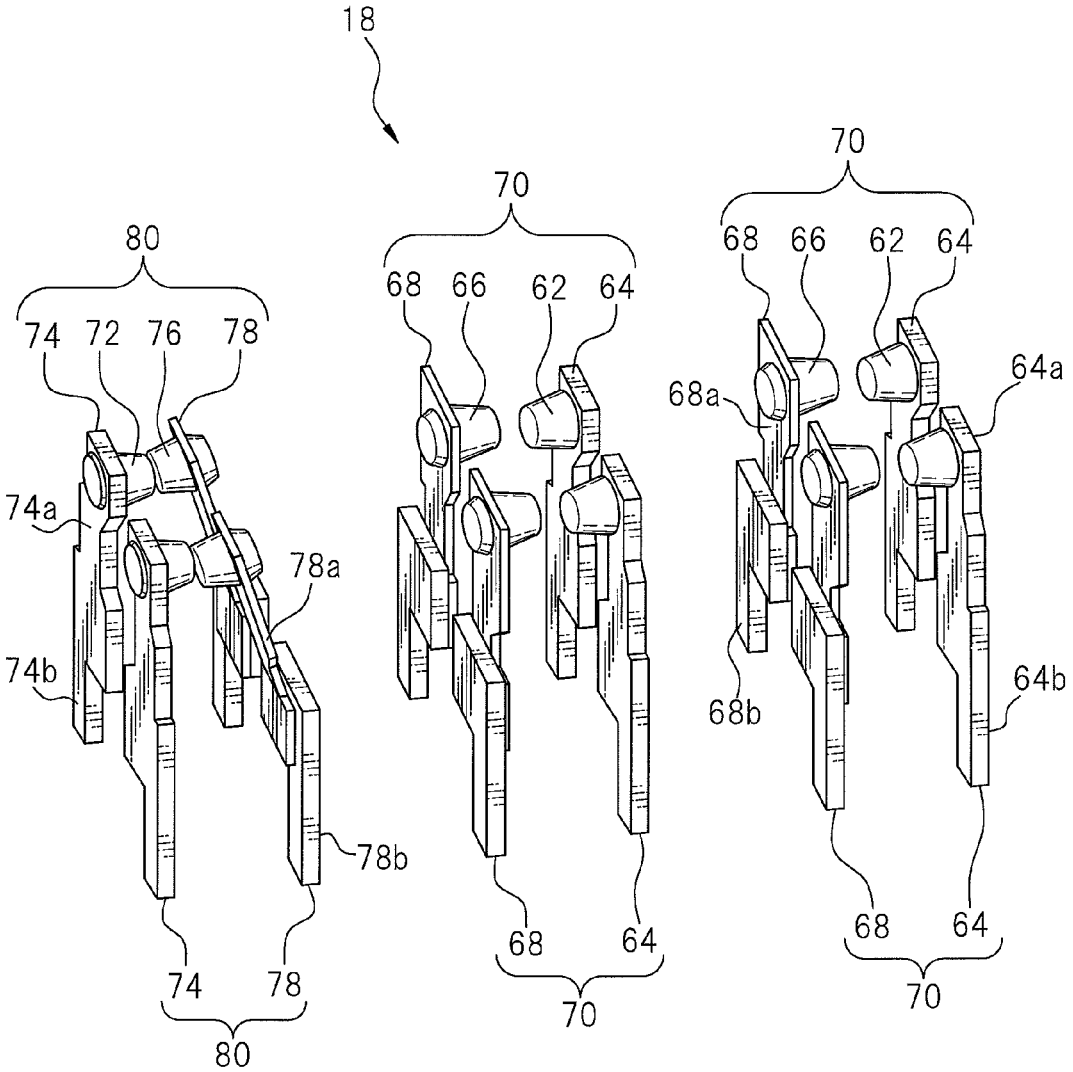
FIG. 6 is an enlarged perspective view depicting a contact section.

The contact section 18 according to the present embodiment includes four sets of contact members, each set including a first fixed contact member 64 provided with a normally open fixed contact 62 and a first movable contact member 68 having spring properties and provided with a normally open movable contact 66 capable of contacting and separating from the normally open fixed contact 62 (FIG. 6). Each set of the first fixed contact member 64 and the first movable contact member 68 is referred to as "normally-open contact set 70".

The contact section 18 further includes two sets of contact members, each set including a second fixed contact member 74 provided with a normally closed fixed contact 72 and a second movable contact member 78 having spring properties and provided with a normally closed movable contact 76 capable of contacting and separating from the normally closed fixed contact 72 (FIG. 6). Each set of the second movable contact member 78 and the second fixed contact member 74 is referred to as "normally-closed contact set 80".

In a case where the polarized electromagnetic relay 10 has a monostable configuration, the normally open fixed contact 62 and the normally open movable contact 66 (hereinafter referred to as a pair of normally open contacts) are set in an open or "break" state when the electromagnet 14 is not excited, and are set in a closed or "make" state when the electromagnet 14 is excited. Further, in the monostable configuration, the normally closed fixed contact 72 and the normally closed movable contact 76 (hereinafter referred to as a pair of normally closed contacts) are set in a closed or "make" state when the electromagnet 14 is not excited, and are set in an open or "break" state when the electromagnet 14 is excited.

On the other hand, in a case where the polarized electromagnetic relay 10 has a bistable configuration, even if the electromagnet 14 is turned to be unexcited from a state where the electromagnet 14 is excited and the pair of normally open contacts is closed and the pair of normally closed contacts opens, the closed state of the pair of normally open contacts and the open state of the pair of normally closed contacts are maintained. The selection between the monostable configuration and the bistable configuration can be made by adjusting a relationship between a magnetic force of the electromagnet 14 and permanent magnet 56 and a spring biasing force of the movable contact members 68 and 78.

Figure 3:
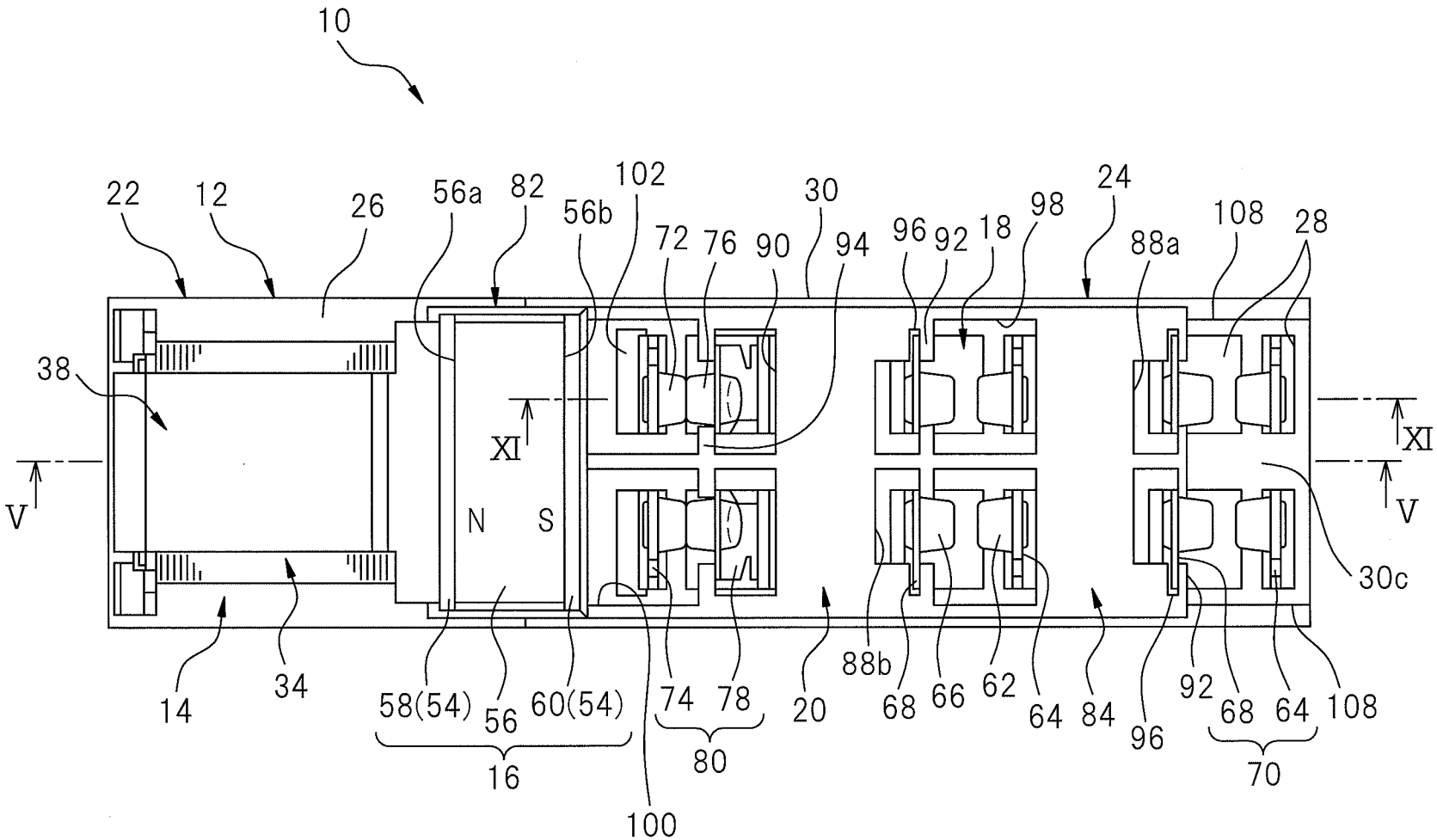
FIG. 3 is a plan view depicting the polarized electromagnetic relay.

The total of twelve contact members of the contact section 18, including the fixed contact members 64 and 74 and the movable contact members 68 and 78, are accommodated in the accommodation holes 28, with two normally-open contact sets 70 and one normally-closed contact set 80 being aligned in the longitudinal direction of the base section 12 at each side of the center wall portion 30*c* (FIG. 3). Moreover, as viewed from a side adjacent to the first portion 22 of the base section 12, the second fixed contact member 74, the second movable contact member 78, the first movable contact member 68, the first fixed contact member 64, the other first movable contact member 68 and the other first fixed contact member 64 are arranged in this order and respectively accommodated in the six accommodation holes 28 formed at each side of the center wall portion 30*c* of the enclosing wall 30 (FIGS. 3, 11A and 11B). The fixed contact members 64 and 74 and the movable contact members 68 and 78 are arranged in symmetrical relationship about the center wall portion 30*c* of the enclosing wall 30.

Each of the fixed contact members 64 and 74 and the movable contact members 68 and 78 is provided with one longitudinal end region 64*a*, 74*a*, 68*a*, 78*a* (hereinafter referred to as an upper region) protruding upward from a top face 30*e* of the enclosing wall 30 and carrying a contact thereon, and the other longitudinal end region 64*b*, 74*b*, 68*b*, 78*b* (hereinafter referred to as a lower region) protruding downward from the bottom face 30*a* and to be connected to, e.g., a conductor of a not-depicted circuit board (FIG. 11). The normally open fixed contact 62 and normally open movable contact 66 of each normally-open contact set 70 are disposed above the enclosing wall 30 so as to face each other in the longitudinal direction of the base section 12. Similarly, the normally closed fixed contact 72 and normally closed movable contact 76 of each normally-closed contact set 80 are disposed above the enclosing wall 30 so as to face each other in the longitudinal direction of the base section 12.

The normally open movable contact 66 and the normally closed movable contact 76 are configured to be displaced in a rocking manner as the transmission member 20 moves in response to the rectilinear movement of the movable magnetic member 16. The normally open movable contact 66 and the normally closed movable contact 76 alternatively contacts with and separated from the normally open fixed contact 62 and the normally closed fixed contact 72, respectively, facing in a rocking direction, so that one contact pair is closed when the other contact pair is opened. Each of the first and second movable contact members 68 and 78 is configured so that at least the portion thereof including the upper region 68*a*, 78*a* is formed by punching a material having spring properties, such as a thin plate of phosphor bronze used for making a spring, and elastically deflects while generating a required spring biasing force, in response to a force applied by the transmission member 20. On the other hand, each of the first and second fixed contact members 64 and 74 is formed as a whole by punching a plate of phosphor bronze used for making a spring of other electrically conductive metal, and has rigidity such that it does not substantially deflect (or only slightly deflects) when subjected to a force applied by the counterpart first or second movable contact member 68, 78 at a time of closing the contacts.

The transmission member 20 includes a first portion 82 supporting the movable magnetic member 16 and a second portion 84 engaging with the first and second movable contact members 68 and 78 (FIGS. 1 and 3). In the plan view of FIG. 3, the transmission member 20 has a substantially rectangular profile smaller than that of the base section 12, and the first portion 82 and the second portion 84 are disposed adjacent each other in the longitudinal direction of the transmission member 20. The transmission member 20 can be integrally formed by, e.g., injection molding from an electrically insulating resin material.

The transmission member 20 is mounted on the enclosing wall 30 so as to face the top face 30*e* thereof, in a state where its longitudinal sides are oriented in parallel to the center axis 34*a* of the coil 34 and the first portion 82 is positioned at a side adjacent to the electromagnet 14 (FIG. 1). In this state, the transmission member 20 can reciprocate in a sliding fashion relative to the base section 12. As will be described later, the transmission member 20 transmits the movement of the armature 54 to the first and second movable contact members 68 and 78 of the contact section 18, and opens and closes the normally open movable contact 66 and normally closed movable contact 76.

Figure 8:
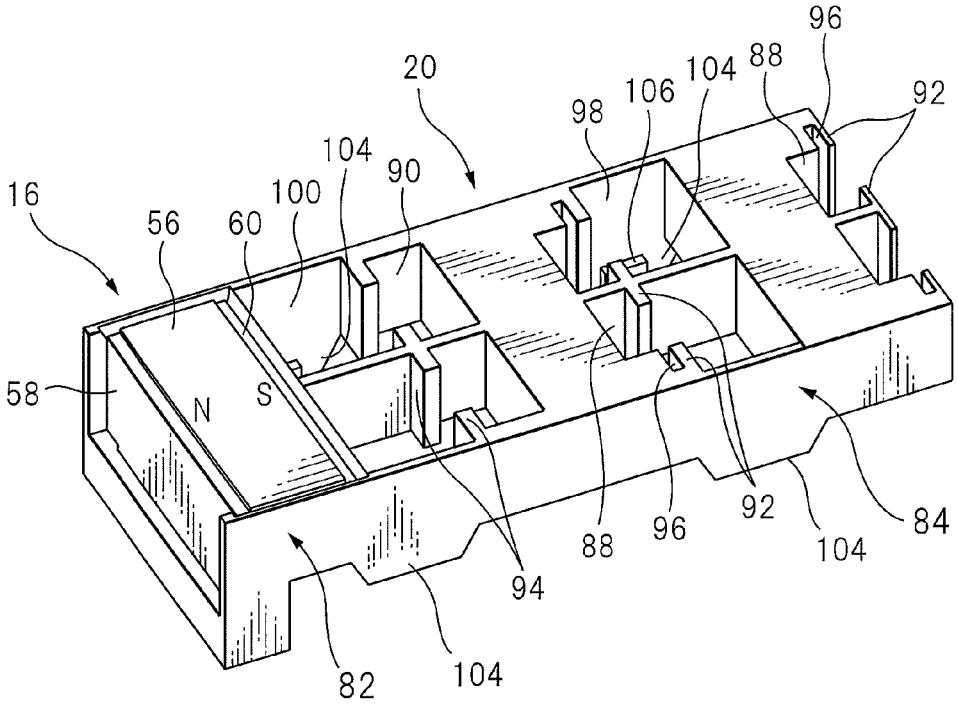
FIG. 8 is an assembled perspective view depicting the movable magnetic member and transmission member of FIG. 7.

The first portion 82 of the transmission member 20 is provided with a hollow space 86 for accommodating the movable magnetic member 16 therein (FIG. 7). The first and second magnetic pole pieces 58 and 60 of the armature 54 and the permanent magnet 56 held between the magnetic pole pieces 58 and 60 are fixed inside the hollow space 86 by, e.g., press fitting or adhesion, with the magnetization direction of the permanent magnet 56 oriented in the longitudinal direction (i.e., in the moving direction) of the transmission member 20 (FIG. 8). When the transmission member 20 is mounted on the enclosing wall 30 of the base section 12, the armature 54 and permanent magnet 56 supported on the first portion 82 and the electromagnet 14 supported on the first portion 22 of the base section 12 are properly positioned in the aforementioned relative arrangement (FIG. 5). The second portion 84 of the transmission member 20 transmits the movement of the transmission member 20 to the first and second movable contact members 68 and 78 supported on the second portion 24 of the base section 12.

The second portion 84 of the transmission member 20 is provided with four first hollow spaces 88 for respectively accommodating the upper regions 68*a* of the first movable contact members 68 and two second hollow spaces 90 for respectively accommodating the upper regions 78*a* of the second movable contact members 78. The first and second hollow spaces 88 and 90 being arranged correspondingly to the arrangement of the first and second movable contact members 68 and 78 on the base section 12 (FIG. 1). Each first hollow space 88 is provided with a pair of first projecting pieces 92 (FIGS. 7 and 8) engagable respectively with the opposite lateral edges of the upper region 68*a* of the first movable contact member 68. The first projecting pieces 92 being opposed to and spaced from each other in the lateral or transverse direction of the transmission member 20. Similarly, each second hollow space 90 is provided with a pair of second projecting pieces 94 (FIGS. 7 and 8) engagable respectively with the opposite lateral edges of the upper region 78*a* of the second movable contact member 78. The second projecting pieces 94 being opposed to and spaced from each other in the lateral or transverse direction of the transmission member 20. Each first hollow space 88 is further provided with a slit 96 (FIGS. 7 and 8), formed adjacent to the first projecting piece 92 at the side of the outer edge of the transmission member 20, for receiving one lateral edge of the upper region 68*a* of the first movable contact member 68.

The first hollow space 88 located farthest from the first portion 82 in the second portion 84 (at a rightmost end in FIGS. 1 and 3) (hereinafter referred to as a rightmost first hollow space 88*a*) is formed so that the pair of first projecting pieces 92 provides an end face of the transmission member 20. The normally open movable contact 66 of the first movable contact member 68 with the upper region 68*a* thereof being accommodated in the rightmost first hollow space 88*a* is disposed so as to protrude outward from the transmission member 20 through the gap between the first projecting pieces 92 and face the normally open fixed contact 62 of the first fixed contact member 64 of the same normally-open contact set 70. The first hollow space 88 located in the middle of the second portion 84 (hereinafter referred to as a middle first hollow space 88*b*) communicates with a third hollow space 98 formed on the opposite side of the pair of first projecting pieces 92 nearer to the rightmost first hollow space 88*a* through the gap between the first projecting pieces 92 (FIGS. 1 and 3). The upper region 64*a* of the first fixed contact member 64 is accommodated in the third hollow space 98. The normally open movable contact 66 of the first movable contact member 68 with the upper region 68*a* thereof being accommodated in the middle first hollow space 88*b* is disposed so as to protrude into the third hollow space 98 through the gap between the first projecting pieces 92 and face the normally open fixed contact 62 accommodated in the third hollow space 98.

The second hollow space 90 communicates with a fourth hollow space 100 formed on the side of the pair of second projecting pieces 94 nearer to the hollow space 86 through the gap between the second projecting pieces 94 (FIGS. 1 and 3). The upper region 74*a* of the second fixed contact member 74 is accommodated in the fourth hollow space 100.

The normally closed movable contact 76 of the second movable contact member 78 with the upper region 78*a* thereof being accommodated in the second hollow space 90 is disposed so as to protrude into the fourth hollow space 100 through the gap between the second projecting pieces 94 and face the normally closed fixed contact 72 accommodated in the fourth hollow space 100. The base section 12 is provided on the top face 30*e* with an upright wall 102 projecting therefrom for supporting the normally closed fixed contact 72 accommodated in the fourth hollow space 100 at a position adjacent to the first portion 22. The wall 102 is also accommodated in the fourth hollow space 100 of the transmission member 20 (FIGS. 1 and 3).

Figure 9:
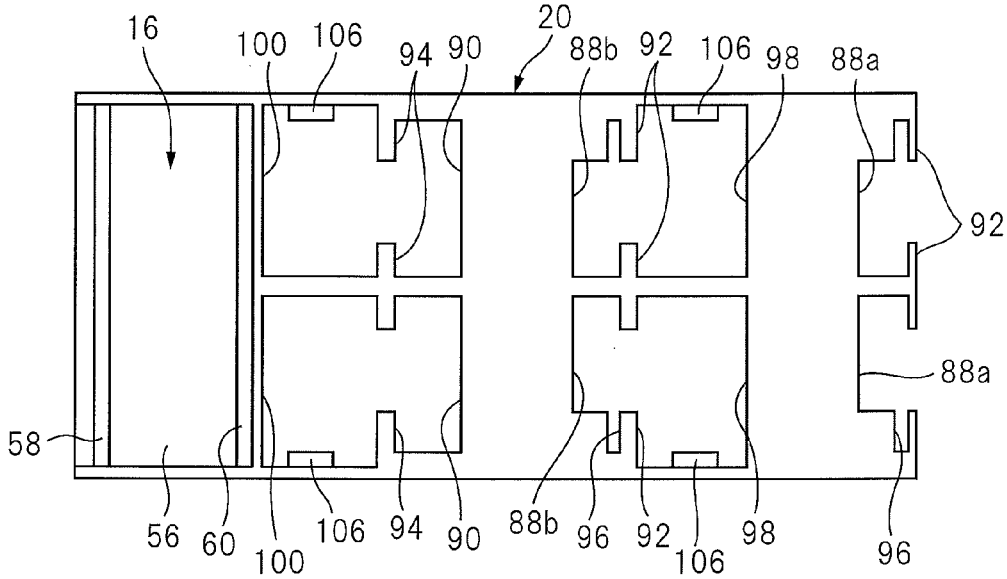
FIG. 9 is a plan view of the movable magnetic member and transmission member.
Figure 10:
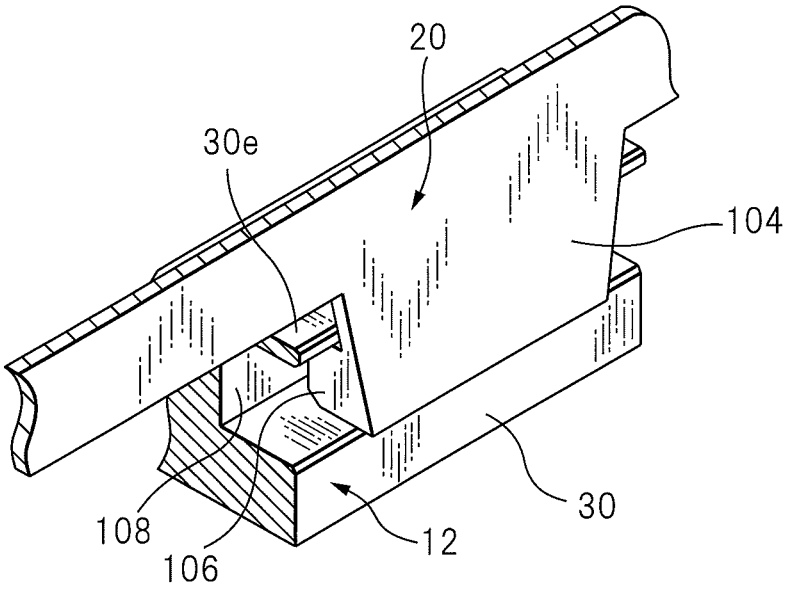
FIG. 10 is an enlarged perspective view depicting a portion of the transmission member.

The transmission member 20 is provided with a total of four pawls 104, two pawls being dispersedly arranged on each side of the coil center axis 34*a*, each of which slidably engages with the base section 12 (only pawls on one side is depicted in FIG. 1). The pawls 104 extend in one direction (downward in the drawing) from the respective side walls of the transmission member 20 at positions symmetrical about the coil center axis 34*a*. As depicted in FIGS. 9 and 10, each pawl 104 is provided with a hook 106 formed to protrude toward the inside of the transmission member 20. The base section 12 is provided with a pair of guide rails 108 for guiding the four pawls 104 in a direction parallel to the coil center axis 34*a*, adjacent to the top face 30*e* of the enclosing wall 30 (FIGS. 1, 3 and 10). The guide rails 108 extend linearly along the longitudinal direction of the base section 12 at positions symmetrical about the coil center axis 34*a*. Each guide rail 108 receives the hooks 106 in a slidable fashion.

As the four pawls 104 formed on both side walls of the transmission member 20 engage with the pair of guide rails 108, the transmission member 20 is held on the base section 12 so as to be prevented from falling off, and the transmission member 20 is enabled to reciprocate in a stable manner on the base section 12. The stability of the reciprocating movement of the transmission member 20 may be further enhanced by providing more than two pawls 104 on each side, i.e., total of more than four pawls 104, symmetrically about the coil center axis 34*a*.

The polarized electromagnetic relay 10 further includes a casing (not depicted) that contains the electromagnet 14, the movable magnetic member 16, the contact section 18 and the transmission member 20. The casing has a substantially rectangular parallelepiped profile, and an opening for inserting therethrough the electromagnet 14, the movable magnetic member 16, the contact section 18 and the transmission member 20 to the interior of the casing is formed in its one side. The casing can be fixed to the base section 12 by an adhesive. The casing can be integrally formed from an electrically insulating resin material.

An exemplary operation of the polarized electromagnetic relay 10 will be described below. The following description is given for an embodiment wherein the polarized electromagnetic relay 10 has a monostable configuration. In the following description, a state where the pair of normally open contacts of the contact section 18 is closed and the pair of normally closed contacts thereof is opened is referred to as an "operating state", and a state where the pair of normally open contacts of the contact section 18 is opened and the pair of normally closed contacts thereof is closed is referred to as a "returned state".

Figure 12A:
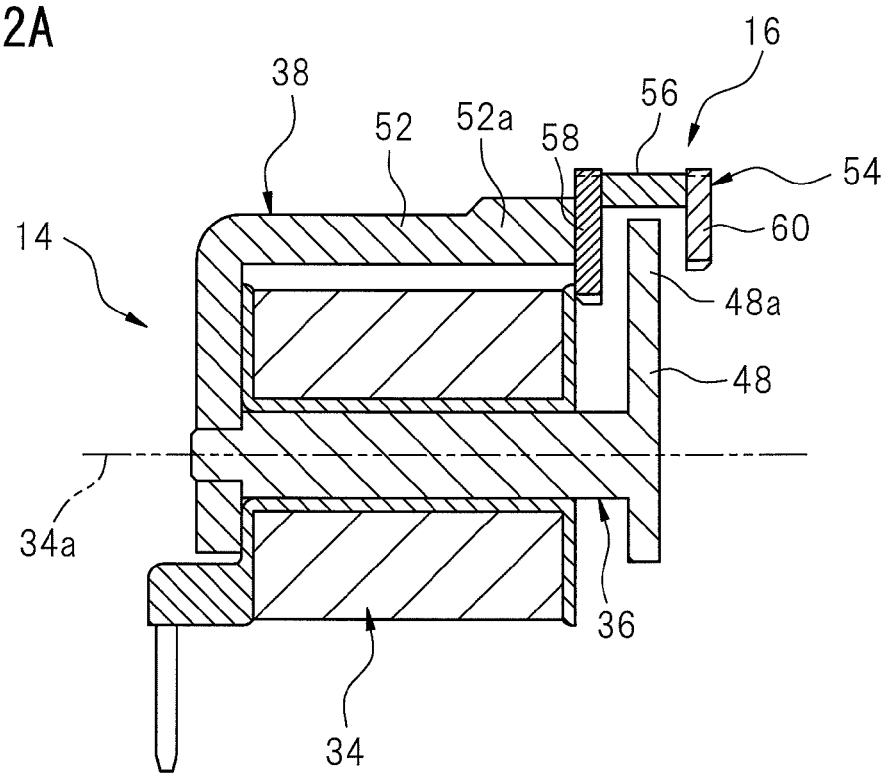
FIG. 12A is a diagram for explaining the operation of the movable magnetic member in the returned state.
Figure 12B:
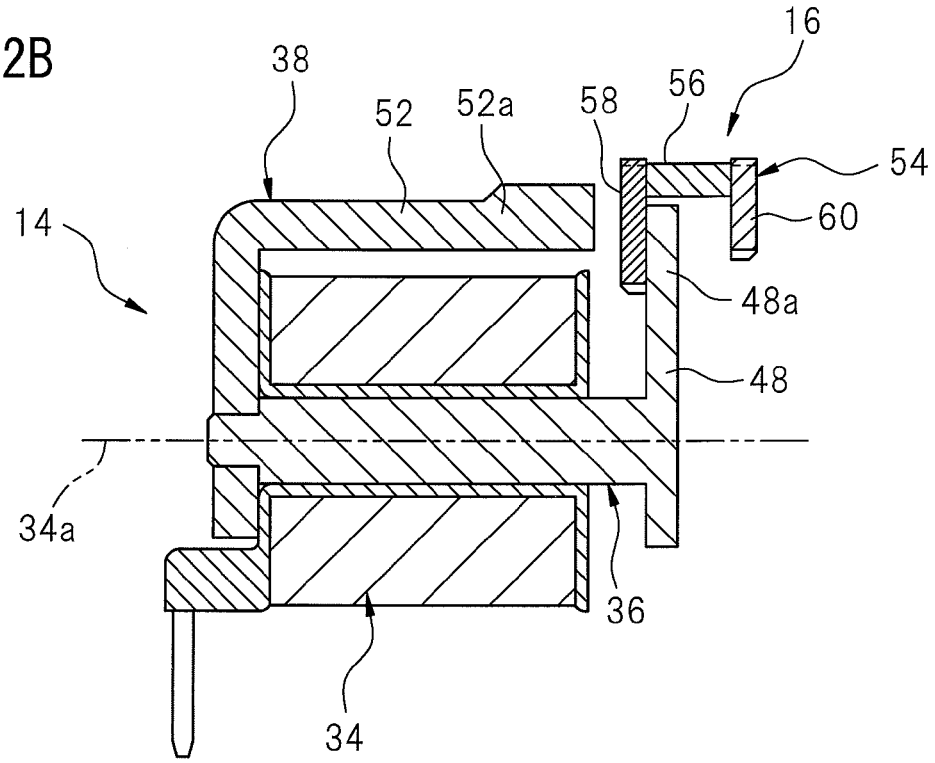
FIG. 12B is a diagram for explaining the operation of the movable magnetic member in the operating state.
Figure 13:
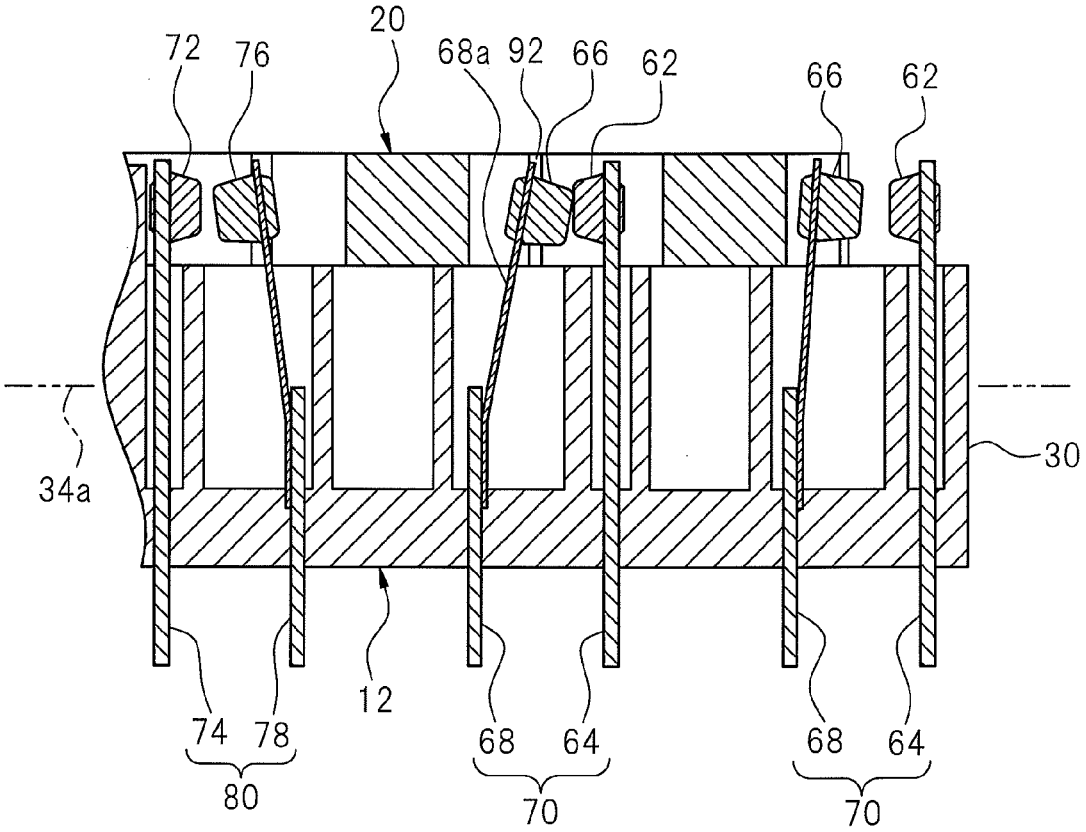
FIG. 13 is a sectional view that depicts the positions of the contact section and the transmission member when contacts are welded together.

FIG. 11A depicts the positions of the contact section 18 and the transmission member 20 when the polarized electromagnetic relay 10 is in the returned state. FIG. 11B depicts the positions of the contact section 18 and the transmission member 20 when the polarized electromagnetic relay 10 is in the operating state. FIG. 12A depicts the position of the movable magnetic member 16 when the polarized electromagnetic relay 10 is in the returned state. FIG. 12B depicts the position of the movable magnetic member 16 when the polarized electromagnetic relay 10 is in the operating state. FIG. 13 depicts the positions of the contact section 18 and the transmission member 20 when one of contact pairs in the contact section 18 is welded.

In the returned state of the polarized electromagnetic relay 10, the contact section 18 is in a condition where each normally closed fixed contact 72 and normally closed movable contact 76 are closed, while each normally open fixed contact 62 and normally open movable contact 66 are opened (FIG. 11A). In this condition, the electromagnet 14 is in an unexcited state, and the movable magnetic member 16 is located at a returned position where the first magnetic pole piece 58 is spaced from the peripheral region 48*a* of the head portion 48 of the core 36 while contacting the end region 52*a* of the major portion 52 of the yoke 38 (FIG. 12A). The transmission member 20 is located at a first limit position of movement closest to the electromagnet 14 (a leftmost position in the drawing) (FIG. 1, FIGS. 3 to 5).

In the returned state, the transmission member 20 does not apply a force for deflection to the respective first and second movable contact members 68 and 78. When the force is not applied by the transmission member 20, the first movable contact member 68 is not deflected, and thus the normally open movable contact 66 is separated from the counterpart normally open fixed contact 62 (this configuration will hereinafter be referred to as an "initial configuration" of the first movable contact member 68). Also, when the force is not applied by the transmission member 20, the second movable contact member 78 is slightly deflected and the normally closed movable contact 76 contacts the counterpart normally closed fixed contact 72, and thus the normally closed movable contact 76 is pressed against the normally closed fixed contact 72 by the action of a spring biasing force (this configuration will hereinafter be referred to as an "initial configuration" of the second movable contact member 78). With the respective first and second movable contact members 68 and 78 maintaining their initial configurations, the contact section 18 is retained at a normally-closed contact "make" position where the normally open movable contact 66 is separated from the normally open fixed contact 62 while the normally closed movable contact 76 contacts the normally closed fixed contact 72 in an electrically-conductive manner (FIG. 11A). In the returned state, a slight amount of magnetic attractive force due to the permanent magnet 56 acts between the first magnetic pole piece 58 and the major portion 52 of the yoke 38.

When the electromagnet 14 is excited in the returned state, magnetic force generated by the electromagnet 14 and the permanent magnet 56 causes the movable magnetic member 16 to move to an operating position where the first magnetic pole piece 58 is spaced from the end region 52*a* of the major portion 52 of the yoke 38 while contacting the peripheral region 48*a* of the head portion 48 of the core 36 (FIG. 12B). The direction of a magnetic flux produced by the excitation of the electromagnet 14 is oriented, with respect to the direction of a magnetic flux produced by the permanent magnet 56, in such a manner that a repulsion force is produced between the first magnetic pole piece 58 and the major portion 52 of the yoke 38 while an attraction force is produced between the first magnetic pole piece 58 and the head portion 48 of the core 36. During the movement of the movable magnetic member 16 from the returned position to the operating position, the transmission member 20 moves together with the movable magnetic member 16 in the direction parallel to the coil center axis 34*a* while the pawls 104 are guided along the guide rails 108 of the base section 14 as the movable magnetic member 16 moves. The rectilinear movement of the transmission member 20 is transmitted via the first projecting pieces 92, slits 96 and second projecting pieces 94 of the transmission member 20 to the upper regions 68*a* and 78*a* of the first and second movable contact members 68 and 78, and the upper regions 68*a*, 78*a* of the movable contact members 68, 78 elastically deflect while increasing the spring biasing force thereof.

Consequently, at the instant when the magnetic force generated by the excitation of the electromagnet 14 in a direction for bringing the first magnetic pole piece 58 into contact with the peripheral region 48*a* of the head portion 48 of the core 36 exceeds the total amount of force required to cause the upper regions 68*a*, 78*a* of the movable contact members 68, 78 to deflect from the initial configurations thereof, the movable magnetic member 16 starts to move from the returned position toward the operating position, and the transmission member 20 starts to move accordingly.

When the movable magnetic member 16 reaches the operating position, the transmission member 20 is located at a second limit position of movement farthest away from the electromagnet 14 (a rightmost position in the drawing) (FIG. 11B). At this moment, the contact section 18 is in a condition where the normally closed fixed contact 72 and normally closed movable contact 76 in each normally-closed contact set 80 are opened, while the normally open fixed contact 62 and normally open movable contact 66 in each normally-open contact set 70 are closed (FIG. 11B). Thus, the polarized electromagnetic relay 10 is set in the operating state.

When the polarized electromagnetic relay 10 is shifted from the returned state to the operating state, a magnetic attractive force generated due to the electromagnet 14 and the permanent magnet 56 acts between the first magnetic pole piece 58 and the head portion 48 of the core 36. As a result, the contact section 18 is retained at a normally-open contact "make" position where the normally closed movable contact 76 is separated from the normally closed fixed contact 72 while the normally open movable contact 66 contacts the normally open fixed contact 62 in an electrically-conductive manner against the spring biasing force of the movable contact members 68, 78 (FIG. 11B).

When the excitation of the electromagnet 14 is halted in the operating state by shutting off an electric current flowing through the coil 34, the spring biasing forces of the respective movable contact members 68 and 78 are applied from the respective upper regions 68*a* and 78*a* to the first projecting pieces 92, slits 96 and second projecting pieces 94, which causes the movable magnetic member 16 to move to the returned position where the first magnetic pole piece 58 is separated from the peripheral region 48*a* while contacting the end region 52*a* (FIG. 12A). During the movement of the movable magnetic member 16 from the operating position to the returned position, the transmission member 20 moves together with the movable magnetic member 16 in the direction parallel to the coil center axis 34*a* while the pawls 104 are guided along the guide rails 108 of the base section 14.

When the movable magnetic member 16 reaches the returned position, the transmission member 20 is located at the first limit position of movement (FIG. 11A). At this moment, the contact section 18 is in a condition where the normally closed fixed contact 72 and normally closed movable contact 76 in each normally-closed contact set 80 are closed, while the normally open fixed contact 62 and normally open movable contact 66 in each normally-open contact set 70 are opened (FIG. 11A). Thus, the polarized electromagnetic relay 10 is set in the returned state.

In an embodiment wherein the polarized electromagnetic relay 10 has a bistable configuration, even if the excitation of the electromagnet 14 is halted in the operating state depicted in FIGS. 11B and 12B, the movable magnetic member 16 is retained at the operating position by the action of the permanent magnet 56, and the contact section 18 is retained at a normally-open contact "make" position. In this state, if the electromagnet 14 is excited in a reverse direction by, e.g., applying electric current through the coil in a direction opposite to the direction of the current applied to shift the relay from the returned state to the operating state, the movable magnetic member 16 moves to the returned position of FIG. 12A due to the magnetic force generated by the electromagnet 14 and the permanent magnet 56.

The direction of a magnetic flux produced at this moment by the electromagnet 14 is oriented, with respect to the direction of a magnetic flux produced by the permanent magnet 56, in such a manner that a repulsion force is produced between the first magnetic pole piece 58 and the head portion 48 of the core 36 while an attraction force is produced between the first magnetic pole piece 58 and the major portion 52 of the yoke 38. During the movement of the movable magnetic member 16 from the operating position to the returned position, the upper regions 68*a* and 78*a* of the first and second movable contact members 68 and 78 tend to be elastically restored to their original configurations.

Consequently, at the instant when the sum of the magnetic force generated by the reverse excitation of the electromagnet 14 in a direction for bringing the first magnetic pole piece 58 into contact with the end region 52*a* of the major portion 52 of the yoke 38 and the elastic restoring forces generated by the movable contact members 68, 78 exceeds the magnetic force generated by the permanent magnet 56 to retain the movable magnetic member 16 at the operating position, the movable magnetic member 16 starts to move from the operating position toward the returned position, and the transmission member 20 starts to move accordingly.

In the returned state, a magnetic attractive force due to the electromagnet 14 and the permanent magnet 56 acts between the first magnetic pole piece 58 and the major portion 52 of the yoke 38. As a result, the contact section 18 is retained at a normally-closed contact "make" position where the normally open movable contact 66 is separated from the normally open fixed contact 62 while the normally closed movable contact 76 contacts the normally closed fixed contact 72 in an electrically-conductive manner (FIG. 11A).

As described above, in accordance with the rectilinear movement of the armature 54 (or the movable magnetic member 16) in the direction parallel to the coil center axis 34*a*, the transmission member 20 rectilinearly moves in the direction parallel to the coil center axis 34*a*, and opens and closes the normally open movable contacts 66 and the normally closed movable contacts 76 in a mechanically mutually interlocked manner. According to the above-described transmission member 20, the polarized electromagnetic relay 10 can be used as a so-called safety relay in which, if the pair of normally open contacts is welded together during the operating state of the relay, it is possible to prevent the pair of normally closed contacts from closing even when the relay is set back to the returned state. A circuit incorporating such a safety relay can detect the welding of the pair of normally open contacts and can maintain a power shutoff condition.

Assuming the case where the normally open fixed contact 62 and normally open movable contact 66 of any one of the four normally-open contact sets 70 are fused together in the operating state of FIG. 11B. If the electromagnet 14 is turned to an unexcited condition in the operating state, the transmission member 20 starts moving toward the returned position. However, the movement of the transmission member 20 stops at the position depicted in FIG. 13, as the upper region 68*a* of the first movable contact member 68 is engaged with the first projecting pieces 92 and the slit 96 of the transmission member 20, and the welded normally-open contact set 70 prevents the transmission member 20 from moving further. Accordingly, even if any of the normally open contact set is welded, the transmission member 20 is retained at a middle position between the first and second limit positions of movement, as depicted in FIG. 13.

When the transmission member 20 is located at the middle position, each of the remaining three normally-open contact sets 70 is set in a contact open state with the normally open fixed contact 62 separated from the normally open movable contact 66, and each of the two normally closed contact sets 80 is also set in a contact open state with a prescribed gap ensured between the normally closed fixed contact 72 and the normally closed movable contact 76.

In the polarized electromagnetic relay 10 of the embodiment, if any normally closed contact set 80 does not close while the transmission member 20 has to be positioned in the returned position, it is possible to detect an abnormal operation of the contact section 18 by detecting the non-closed condition of the normally-closed contact set 80, by using a circuit incorporated in the polarized electromagnetic relay 10. Thus, it is possible to detect the welding of the pair of normally open contacts in any of the normally-open contact sets 70 as a possible cause for the abnormal operation of the contact section 18. Note that such an application of the polarized electromagnetic relay 10 as a safety relay can be implemented as long as the polarized electromagnetic relay 10 includes at least one normally-open contact set 70 and at least one normally-closed contact set 80. As the number of normally-open contact sets 70 and normally-closed contact sets 80 increases, the safety and reliability of the safety relay can be improved.

In the polarized electromagnetic relay 10 of the embodiment, the electromagnet 14 is mounted with the center axis 34*a* of the coil 34 oriented in parallel to the bottom faces 26*a*, 30*a* of the base section 12, and is designed to move the movable magnetic member 16 rectilinearly in the direction parallel to the center axis 34*a* of the coil 34. Therefore, it is possible to effectively reduce the entire outer dimensions of the relay 10 defined in the radial direction of the coil. Furthermore, the first and second magnetic pole pieces 58 and 60 are designed to hold therebetween the permanent magnet 56 in the magnetization direction thereof and to orient the magnetization direction in parallel to the coil center axis 34*a*, and therefore, the movable magnetic member 16 can be simplified and downsized. Further, the armature 54 is fixedly connected to the transmission member 20 with the first and second magnetic pole pieces 58, 60 holding the permanent magnet 56 therebetween, and therefore, it is possible to effectively transmit the moving action of the armature 54 to the contact section 18 by the transmission member 20.

As described above, the polarized electromagnetic relay 10 includes two or more contact pairs, i.e., four or more contact members that can be used to implement a safety relay. Further, the moving direction of the movable magnetic member 16, the magnetization direction of the permanent magnet 56, and the moving direction of the transmission member 20 are all aligned in parallel to the coil center axis 34*a*. Therefore, the polarized electromagnetic relay 10 can be easily downsized, especially decreased in height, and can reduce power consumption due to a polarized configuration.

In the above-described polarized electromagnetic relay 10, the magnetic pole pieces 58, 60 of the armature 54 have respective sizes different from each other in a direction substantially perpendicular to the coil center axis 34*a*. Magnetic force acting on the armature 54 during the excitation of the electromagnet 14 varies depending on the size of the surface of each magnetic pole piece 58, 60 forming a pole face of the armature 54 to which the permanent magnet 56 is attached. Accordingly, when the magnetic pole pieces 58, 60 have different sizes, magnetic force acting on a larger magnetic pole piece is greater than magnetic force acting on a smaller magnetic pole piece.

In the illustrated configuration, the first magnetic pole piece 58 that alternately contacts the peripheral region 48*a* of the head portion 48 of the core 36 and the end region 52*a* of the major portion 52 of the yoke 38 is larger than the second magnetic pole piece 60. Therefore, it is possible to increase a magnetic force acting on the armature 54 when the electromagnet 14 is excited, in comparison with a configuration wherein the first magnetic pole piece 58 has the same size as the second magnetic pole piece 60.

Figure 14:
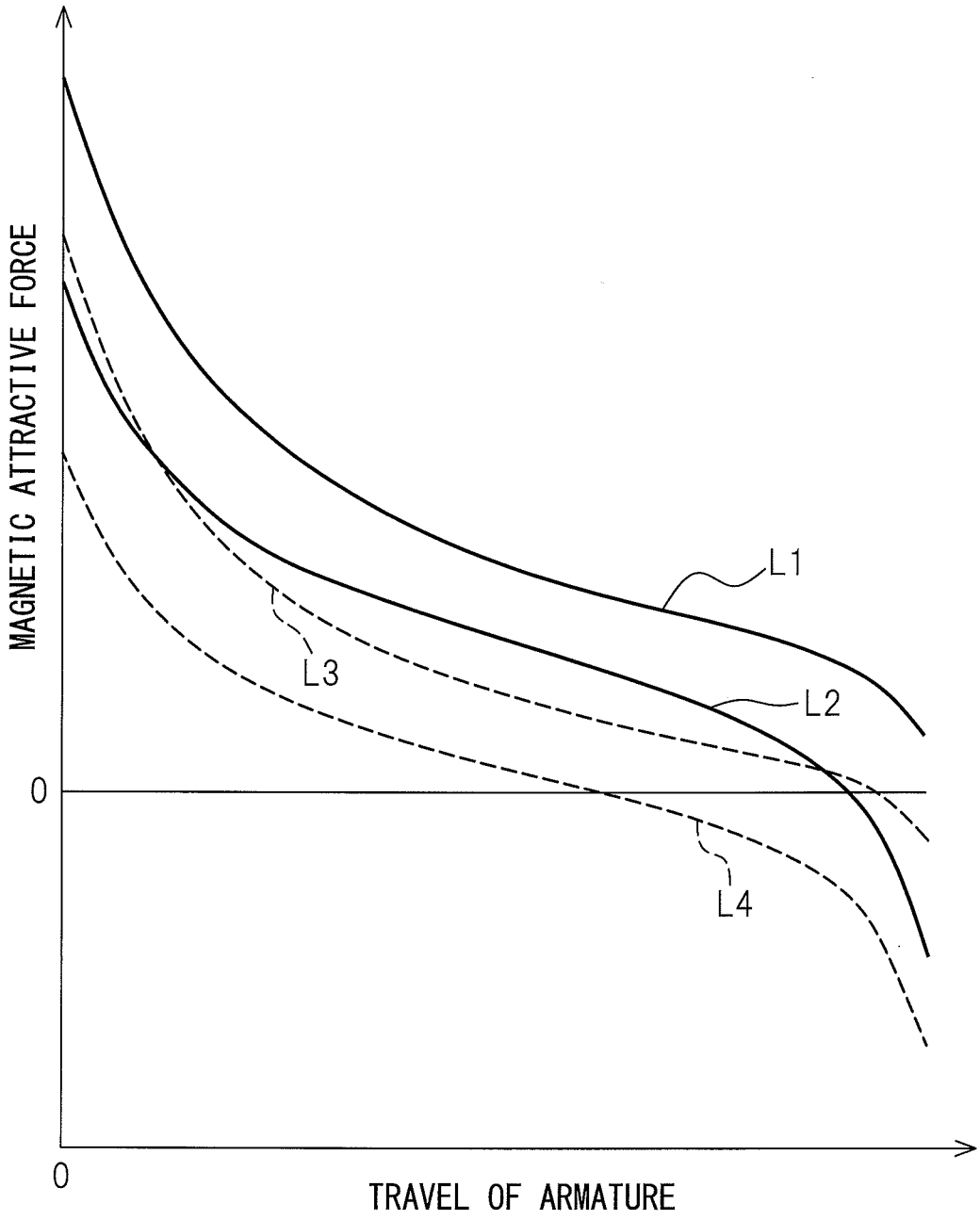
FIG. 14 is a diagram depicting a relationship between a magnetic attractive force and an armature travel.

FIG. 14 depicts a relationship between a magnetic attractive force and a travel or moving distance of the armature 54 in a configuration in which the first magnetic pole piece 58 has a size larger than the second magnetic pole piece 60 (example 1), in comparison with a configuration in which the first magnetic pole piece 58 has a size identical to the second magnetic pole piece 60 (example 2). In FIG. 14, a horizontal axis represents travel, or moving distance, of the armature 54 from the position where the first magnetic pole piece 58 contacts the peripheral region 48*a* (FIG. 12B) when the first magnetic pole piece 58 moves toward the end region 52*a*. A vertical axis represents a magnetic attractive force generated by the electromagnet 14 and the permanent magnet 56 to attract the first magnetic pole piece 58 toward the peripheral region 48*a* of the head portion 48. A positive magnetic attractive force is a force for attracting the first magnetic pole piece 58 toward the head portion 48 of the core 36, and a negative magnetic attractive force is a force for repulsing the first magnetic pole piece 58 away from the head portion 48 of the core 36.

In FIG. 14, solid line L1 represents a relationship between the travel of the armature and the magnetic attractive force at a certain pick-up (or operate) ampere in example 1. Solid line L2 represents a relationship between the travel of the armature and the magnetic attractive force at a drop-out (or release) ampere (i.e., zero ampere) in example 1. Dashed line L3 represents a relationship between the travel of the armature and the magnetic attractive force at a certain pick-up (or operate) ampere in example 2. Dashed line L4 represents a relationship between the travel and the magnetic attractive force at a drop-out (or release) ampere (i.e., zero ampere) in example 2. As depicted, in example 1, compared with example 2, the magnetic attractive force is increased over the entire travel of the armature 54. The increase in the magnetic attractive force can make the magnetic attractive force correspond to the magnitude of the spring biasing force applied to the armature 54 from the movable contact members 68, 78 via the transmission member 20, and thus can optimize the operating characteristics of the polarized electromagnetic relay 10. Accordingly, when the size of the first magnetic pole piece 58 is adjusted in the direction perpendicular to the coil center axis 34*a*, it is possible to adjust the operating characteristics of the polarized electromagnetic relay 10 so as to correspond to the magnitude of the spring biasing force.

In the above-described polarized electromagnetic relay 10, the electromagnet 14 is oriented so that the head portion 48 of the core 36 is located between the coil 34 and the contact section 18. When the electromagnet 14 is oriented in this manner, it is possible to change a relationship between a magnetic attractive force and a travel of the armature 54 as described below, compared with a reverse configuration in which the head portion 48 of the core 36 is located at a side spaced away from the contact section 18. In this connection, it is presumed that, when the orientation of the electromagnet 14 relative to the contact section 18 is reversed, the relationship between the magnetic force generated due to the electromagnet 14 and the permanent magnet 56 and the spring biasing force of the movable contact members 68, 78 changes, and the relationship between the magnetic attractive force and the travel of the armature 54 changes.

Figure 15:
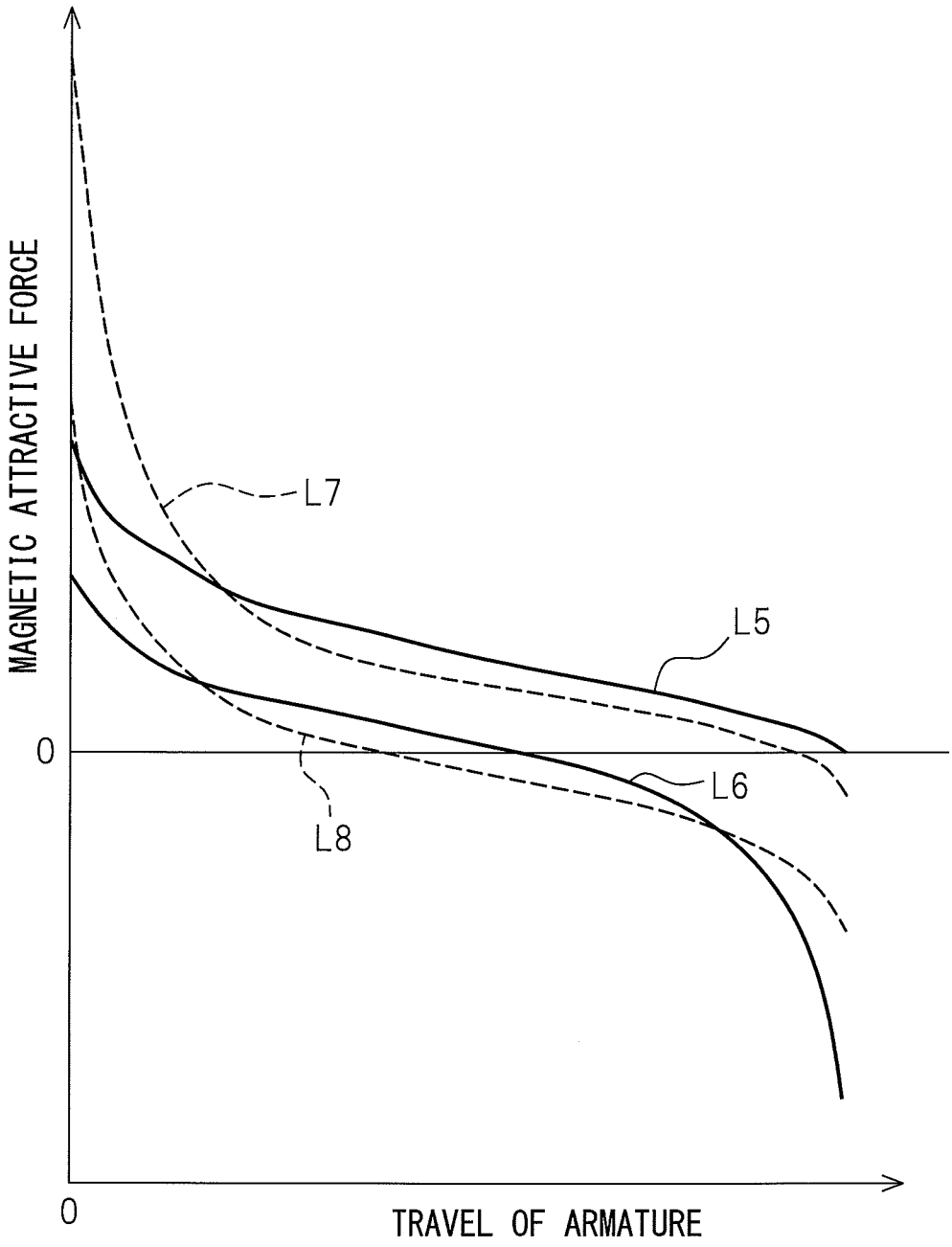
FIG. 15 is a diagram depicting the relationship between a magnetic attractive force and an armature travel.

FIG. 15 depicts a relationship between a magnetic attractive force and a travel of the armature 54 in a configuration in which the head portion 48 of the core 36 is located between the coil 34 and the contact section 18 (example 3) in comparison with a reverse configuration (example 4). In FIG. 15, a horizontal axis and a vertical axis represent the travel of the armature and the magnetic attractive force, respectively, in the same manner as in FIG. 14. In FIG. 15, solid line L5 represents a relationship between the travel and the magnetic attractive force at a certain pick-up (or operate) ampere in example 3. Solid line L6 represents a relationship between the travel and the magnetic attractive force at a drop-out (or release) ampere (i.e., zero ampere) in example 3. Dashed line L7 represents a relationship between the travel and the magnetic attractive force at a pick-up (or operate) ampere in example 4. Dashed line L8 represents a relationship between the travel and the magnetic attractive force at a drop-out (or release) ampere (i.e., zero ampere) in example 4. As depicted in FIG. 15, in example 3, compared with example 4, the rate of change in the magnetic attractive force is reduced, especially when a travel of the armature 54 is relatively small. The reduction in the rate of change in the magnetic attractive force can approximate the rate of change in the magnetic attractive force to the rate of change in the magnitude of the spring biasing force applied to the armature 54 from the movable contact members 68, 78 via the transmission member 20, and thus can optimize the operating characteristics of the polarized electromagnetic relay 10. Accordingly, when either example 3 or 4 is selected as the orientation of the electromagnet 14 relative to the contact section 18, it is possible to appropriately change the operating characteristics of the polarized electromagnetic relay 10 so as to correspond to the rate of change in the magnitude of the spring biasing force.

In the above-described polarized electromagnetic relay 10, the first magnetic pole piece 58 is spaced from the peripheral region 48*a* and contacts the end region 52*a*, and the second magnetic pole piece 60 is spaced from the peripheral region 48*a* in the returned state of the relay, as depicted in FIG. 12A. In other words, in the returned state, a clearance is defined between both of the first and second magnetic pole pieces 58, 60 and the peripheral region 48*a*. The clearance defined between the second magnetic pole piece 60 and the head portion 48 of the core 36 in the returned state is, e.g., about 0.2 mm. The size of the clearance can be appropriately set by selecting the dimension of the permanent magnet 56 in a direction parallel to the coil center axis 34*a* or a minimum distance between the peripheral region 48*a* and the end region 52*a*.

In the configuration where the armature 54 operates so that a clearance is defined between the first and second magnetic pole pieces 58, 60 and the peripheral region 48*a* in the returned state, it is possible to reduce the rate of change in the magnetic attractive force, especially in a range of a less travel of the armature 54, in the same manner as in example 3 depicted in FIG. 15, compared with a configuration in which the first magnetic pole piece 58 contacts the end region 52*a* and simultaneously the second magnetic pole piece 60 contacts the peripheral region 48*a* in the returned state. Further, it is possible to adjust the rate of change in the magnetic attractive force in accordance with the size of the above clearance. In this connection, it is presumed that, when the clearance is provided or not provided, or when the size of the above clearance is changed, the relationship between the magnetic force generated by the electromagnet 14 and the permanent magnet 56 and the spring biasing force of the movable contact members 68, 78 changes, and the relationship between the magnetic attractive force and the travel of the armature 54 changes.

Figure 16A:
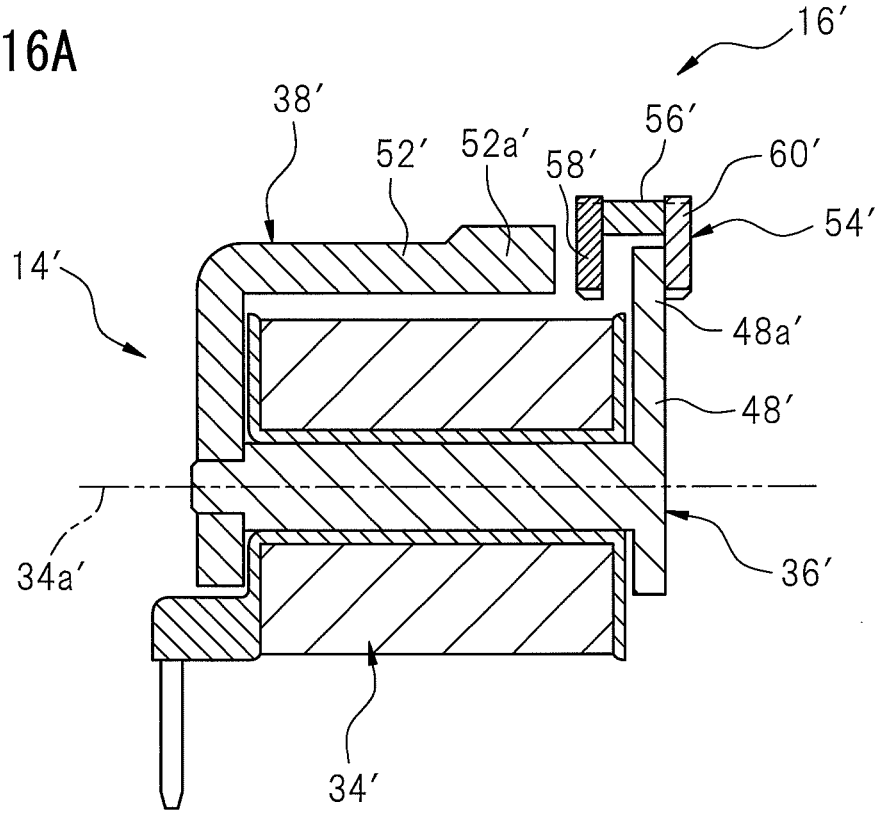
FIG. 16A is a diagram for explaining the operation of a movable magnetic member in a returned state.
Figure 16B:
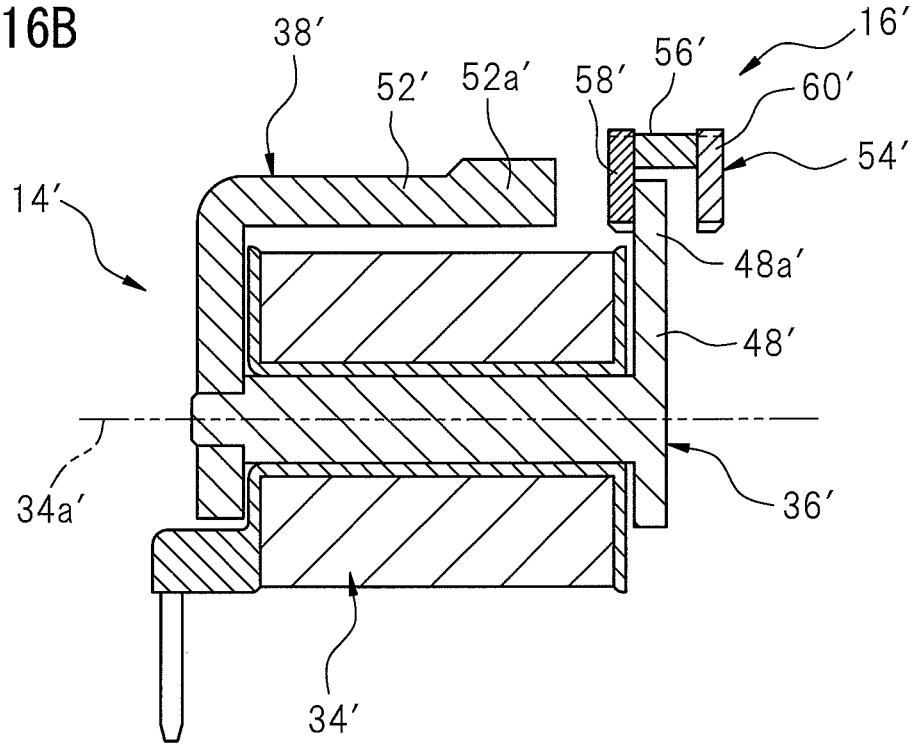
FIG. 16B is a diagram for explaining the operation of a movable magnetic member in an operating state.

FIG. 16 depicts a modification of the polarized electromagnetic relay 10. In the modification of FIG. 16, the first magnetic pole piece 58' of the armature 54' is spaced from both of the peripheral region 48*a'* and the end region 52*a'*, while the second magnetic pole piece 60' of the armature 54' contacts the peripheral region 48*a'* in the returned state of the relay (FIG. 16A). On the other hand, in the operating state of the relay, the first magnetic pole piece 58' is spaced from the end region 52*a'* and contacts the peripheral region 48*a'*, while the second magnetic pole piece 60' is spaced from the peripheral region 48*a'* (FIG. 16B). In other words, in the returned state, a clearance is defined between the first magnetic pole piece 58' and both of the head portion 48' of the core 36' and the end region 52*a'* of the yoke 38'. The clearance defined between the first magnetic pole piece 58' and the end region 52*a'* of the yoke 38' in the returned state is, e.g., about 0.2 mm. The size of the clearance can be appropriately set by selecting the dimension of the permanent magnet 56' in a direction parallel to the coil center axis 34*a'* or a minimum distance between the peripheral region 48*a'* of the head portion 48' of the core 36' and the end region 52*a'* of the major portion 52' of the yoke 38'.

In the configuration where the armature 54' operates so that a clearance is defined between the first magnetic pole piece 58' and both of the head portion 48' of the core 36' and the end region 52*a'* of the yoke 38' in the returned state, it is possible to reduce the rate of change in the magnetic attractive force, especially in a range of a less travel of the armature 54', in the same manner as in example 3 depicted in FIG. 15, compared with a configuration in which the second magnetic pole piece 60' contacts the peripheral region 48*a'* and simultaneously the first magnetic pole piece 58' contacts the end region 52*a'* in the returned state. Further, it is possible to adjust the rate of change in the magnetic attractive force in accordance with the size of the above clearance. Note that the modification depicted in FIG. 16 is configured so that the first and second magnetic pole pieces 58' and 60' have a mutually identical size.

While the invention has been described with reference to specific embodiments, it will be understood by those skilled in the art that various changes and modifications may be made thereto without departing from the scope of the following claims.

The invention claimed is:

1. An electromagnetic relay, comprising:

an electromagnet that includes a coil wrapped around a shaft disposed along a center axis of the coil and having first and second axial ends;

a first contact that includes first contact members respectively supporting a first fixed contact and a first movable contact that contacts with and is separated from the first fixed contact;

a second contact that includes second contact members, separately formed from the first contact members, respectively supporting a second fixed contact and a second movable contact that contacts with and is separated from the second fixed contact;

a transmission member that is movable in a direction along the center axis of the coil, and simultaneously actuates the first movable contact and the second movable contact so as to alternatively open and close the first contact and the second contact; and a first magnetic pole piece attached to the transmission member, and is actuated in response to excitation of the electromagnet;

a second magnetic pole piece attached to the transmission member to align with the first magnetic pole piece in the direction along the center axis, and actuated together with the first magnetic pole piece; and a permanent magnet attached between the first and second magnetic pole pieces, having a magnetization direction of the permanent magnet parallel to the center axis;

wherein the transmission member moves in response to the actuation of the first and second magnetic pole pieces;

wherein the electromagnet further includes a head portion, located between the coil and the first and second contacts and positioned between the first and second magnetic pole pieces, radially extending outward from the first axial end of the shaft to outside the coil; and a yoke connected at a first end to the second axial end of the shaft and extending outside the coil toward the head portion at a second end; and wherein one of the first and second magnetic pole pieces is located between the head portion and the second end of the yoke.

2. The electromagnetic relay of claim 1, wherein said first and second magnetic pole pieces have respective sizes different from each other.

3. The electromagnetic relay of claim 2, wherein one of the magnetic pole pieces, located between the coil and the head portion, is larger than the other of the magnetic pole pieces.

4. The electromagnetic relay of claim 1, wherein a clearance is defined between one of said first and second magnetic pole pieces and said head portion when the transmission member is in a returned state.

5. The electromagnetic relay of claim 1, further comprising a base section that supports said first and second contacts, wherein said transmission member includes a pawl that slidably engages with said base section; and wherein said base section includes a guide rail that guides said pawl along said direction parallel to said center axis.

6. The electromagnetic relay of claim 1, wherein the first contact is a normally-open contact and the second contact is a normally-closed contact, and wherein said transmission member operates to ensure a gap between said second fixed contact and said second movable contact when the first fixed contact is welded to the first movable contact.

7. An electromagnetic relay, comprising:

an electromagnet that includes a coil;

a base;

a first contact that includes a first fixed contact member having one end fixed to the base and another end on which a first fixed contact is provided, a first movable contact member having one end fixed to the base and another end on which a first movable contact is provided, wherein the first contact is a normally-open contact, and the first movable contact contacts with and is separated from the first fixed contact;

a second contact, physically separated from the first contact, that includes a second fixed contact member having one end fixed to the base and another end on which a second fixed contact is provided, a second movable contact member having one end fixed to the base and another end on which a second movable contact is provided, wherein the second contact is a normally-closed contact, and the second movable contact contacts with and is separated from the second fixed contact; and a transmission member that is movable in a direction along a center axis of the coil, and simultaneously actuates the first movable contact member and the second movable contact member so as to alternatively open and close the first contact and the second contact, the transmission member having a slit that receives one of opposite lateral edges of the other end of the first movable contact member, on which the first movable contact is provided, and a pair of projecting pieces engageable respectively with the opposite lateral edges.

8. The electromagnetic relay of claim 7, wherein said transmission member operates to ensure a gap between said second fixed contact and said second movable contact when the first fixed contact is welded to the first movable contact.

* * * * *